US009152065B2

(12) United States Patent
Sano et al.

(10) Patent No.: US 9,152,065 B2
(45) Date of Patent: Oct. 6, 2015

(54) MAGNETIC TONER

(71) Applicant: CANON KABUSHIKI KAISHA, Tokyo (JP)

(72) Inventors: Tomohisa Sano, Mishima (JP); Michihisa Magome, Mishima (JP); Yusuke Hasegawa, Suntou-gun (JP); Atsuhiko Ohmori, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/364,636

(22) PCT Filed: Jan. 31, 2013

(86) PCT No.: PCT/JP2013/052786
§ 371 (c)(1),
(2) Date: Jun. 11, 2014

(87) PCT Pub. No.: WO2013/115412
PCT Pub. Date: Aug. 8, 2013

(65) Prior Publication Data

US 2014/0342278 A1 Nov. 20, 2014

(30) Foreign Application Priority Data

Feb. 1, 2012 (JP) ..... 2012-019518

(51) Int. Cl.
*G03G 9/083* (2006.01)
*G03G 9/097* (2006.01)

(52) U.S. Cl.
CPC ..... *G03G 9/0833* (2013.01); *G03G 9/0836* (2013.01); *G03G 9/0837* (2013.01); *G03G 9/0839* (2013.01); *G03G 9/09708* (2013.01); *G03G 9/09725* (2013.01)

(58) Field of Classification Search
CPC ..... G03G 9/08797; G03G 9/08755; G03G 9/0819; G03G 9/09741; G03G 9/0975; G03G 9/09758; G03G 9/09708; G03G 9/09716; G03G 9/09725
See application file for complete search history.

(56) References Cited

U.S. PATENT DOCUMENTS

| | | | | |
|---|---|---|---|---|
| 4,433,042 | A | 2/1984 | Kawanishi et al. | |
| 6,485,876 | B1 | 11/2002 | Takezawa et al. | |
| 7,457,572 | B2 | 11/2008 | Onuma et al. | |
| 2005/0089785 | A1* | 4/2005 | Chiba et al. | 430/106.1 |
| 2009/0047043 | A1* | 2/2009 | Dojo et al. | 399/252 |

FOREIGN PATENT DOCUMENTS

| | | | |
|---|---|---|---|
| GB | 2 021 794 | A | 12/1979 |
| JP | 54-139545 | A | 10/1979 |

(Continued)

OTHER PUBLICATIONS

U.S. Appl. No. 14/364,638, filed Jun. 11, 2014. Inventor: Tanaka, et al.

(Continued)

*Primary Examiner* — Hoa V Le
(74) *Attorney, Agent, or Firm* — Fitzpatrick, Cella, Harper and Scinto

(57) ABSTRACT

A magnetic toner includes: magnetic toner particles containing a binder resin and a magnetic body; and inorganic fine particles that are present on the surface of the magnetic toner particles and are not a magnetic iron oxide and magnetic iron oxide particles that are present on the surface of the magnetic toner particles, wherein the inorganic fine particles present on the surface of the magnetic toner particles contain metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles; when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the coverage ratio A and B/A satisfy prescribed ranges; and the magnetic iron oxide particles present on the magnetic toner particles' surface are from at least 0.10 mass % to not more than 5.00 mass % with respect to the total amount of the magnetic toner.

3 Claims, 10 Drawing Sheets

(56) References Cited

FOREIGN PATENT DOCUMENTS

| | | | |
|---|---|---|---|
| JP | 57-97545 | A | 6/1982 |
| JP | 8-328291 | A | 12/1996 |
| JP | 2000-214625 | A | 8/2000 |
| JP | 2001-117267 | A | 4/2001 |
| JP | 2005-37744 | A | 2/2005 |
| JP | 2005-134751 | A | 5/2005 |
| JP | 3812890 | B2 | 8/2006 |
| JP | 2007-108675 | A | 4/2007 |
| JP | 2007-293043 | A | 11/2007 |
| JP | 2008-15248 | A | 1/2008 |

OTHER PUBLICATIONS

U.S. Appl. No. 14/364,640, filed Jun. 11, 2014. Inventor: Nomura, et al.
U.S. Appl. No. 14/364,634, filed Jun. 11, 2014. Inventor: Uratani, et al.
U.S. Appl. No. 14/364,633, filed Jun. 11, 2014. Inventor: Ohmori, et al.
U.S. Appl. No. 14/362,377, filed Jun. 2, 2014. Inventor: Matsui, et al.
U.S. Appl. No. 14/362,380, filed Jun. 2, 2014. Inventor: Suzumura, et al.
U.S. Appl. No. 14/364,067, filed Jun. 9, 2014. Inventor: Hasegawa, et al.
U.S. Appl. No. 14/364,065, filed Jun. 9, 2014. Inventor: Hiroko, et al.
U.S. Appl. No. 14/364,068, filed Jun. 9, 2014. Inventor: Magome, et al.
Taiwanese Office Action dated Dec. 26, 2014 in Taiwanese Application No. 102104006.
PCT International Search Report and Written Opinion of the International Searching Authority, International Application No. PCT/JP2013/052786, Mailing Date Apr. 16, 2013.

* cited by examiner

MAGNETIC TONER

TECHNICAL FIELD

The present invention relates to a magnetic toner for use in recording methods that use, for example, electrophotographic methods.

BACKGROUND ART

Numerous methods are known for the execution of electrophotography. At a general level, using a photoconductive material an electrostatic latent image is formed on an electrostatic latent image-bearing member (also referred to as a "photosensitive member" below) by various means. Then, a visible image is made by developing this electrostatic latent image with toner; as necessary the toner image is transferred to a recording medium such as paper; and a copied article is obtained by fixing the toner image on the recording medium by, for example, the application of heat or pressure. For example, copiers and printers are image-forming apparatuses that use such an electrophotographic procedure.

Previously, these printers and copiers were connected in networks and such printers were often tasked with printing from a large number of people. However, the modalities of use have grown increasingly diverse in recent years, and, for example, personal computers (PCs) and printers are also located locally outside the office and its normal environment, i.e., in high-temperature, high-humidity environments or low-temperature, low-humidity environments, and situations in which a task or activity is accomplished by printing an image are also on the increase. As a consequence, smaller size, high durability, and the ability to adapt to a wide range of environments are strongly desired in a printer.

A magnetic monocomponent development procedure using a magnetic toner (also referred to below simply as toner) is preferably used in relation to downsizing and high durability. When the environmental adaptability is more closely considered, the humidity presents itself among environmental factors as a factor that has a major influence on electrophotographic technology. The humidity contributes to quality variations in the development step as it has an effect on the amount and distribution of toner charge, and meanwhile it also has a major effect on the transfer step.

Considering problems related to the transfer step more closely, transfer defects are an example of image defects that are realized when there are problems during transfer. In the transfer step, the toner on the electrostatic latent image-bearing member is subjected to a transfer bias and is transferred onto the recording medium by electrostatic attraction. At this point, toner may remain on the electrostatic latent image-bearing member without undergoing transfer and the toner layer may undergo disturbances during transfer and defects and nonuniformity on the image may be produced as a result. These are called transfer defects. A discharge phenomenon—which can occur between the electrostatic latent image-bearing member and the transfer material due to the large bias being applied between the electrostatic latent image-bearing member and the transfer material—is a cause of transfer defects. When discharge occurs, the toner becomes an inversion component without maintaining the original amount of charge and undergoes re-transfer to the electrostatic latent image-bearing member. Due to this, the toner remaining on the electrostatic latent image-bearing member increases and the image may be disturbed and white voids may be formed.

In order to improve the transferability, countermeasures have been pursued to date through the external addition of a magnetic body while maintaining the flowability (Patent Literature 1, Patent Literature 2). However, the effects are inadequate in a high-humidity environment, in which discharge readily occurs.

On the other hand, toners have been disclosed that have sought to solve problems by focusing on the release of external additives (refer to Patent Literatures 3 and 4), but toner transferability again cannot be regarded as adequate in these cases.

Moreover, Patent Literature 5 teaches stabilization of the development—transfer steps by controlling the total coverage ratio of the toner base particles by the external additives, and a certain effect is in fact obtained by controlling the theoretical coverage ratio, provided by calculation, for a certain prescribed toner base particle. However, the actual state of adhesion by external additives is substantially different from the value calculated assuming the toner to be a sphere, and this theoretical coverage ratio has little effect with regard to the transferability in a high-humidity environment, which is the problem identified above, and improvement has thus been required.

CITATION LIST

Patent Literature

[PTL 1] Japanese Patent Application Publication No. 2000-214625

[PTL 2] Japanese Patent Application Publication No. 2005-37744

[PTL 3] Japanese Patent Application Publication No. 2001-117267

[PTL 4] Japanese Patent Publication No. 3812890

[PTL 5] Japanese Patent Application Publication No. 2007-293043

SUMMARY OF INVENTION

Technical Problems

The present invention was pursued considering the problems identified above for the prior art and provides a magnetic toner that gives a high image density and exhibits an excellent transferability.

Solution to Problem

The present invention relates to a magnetic toner comprising: magnetic toner particles comprising a binder resin and a magnetic body; and inorganic fine particles that are present on the surface of the magnetic toner particles and are not a magnetic iron oxide and magnetic iron oxide particles that are present on the surface of the magnetic toner particles, wherein;

the inorganic fine particles present on the surface of the magnetic toner particles comprise metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein;

when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the magnetic toner has a coverage ratio A of at least 45.0% and not more than 70.0% and a ratio [coverage ratio B/coverage ratio A] of the coverage ratio B to the coverage ratio A of at least 0.50 and not more than 0.85, and wherein;

the magnetic iron oxide particles present on the surface of the magnetic toner particles are from at least 0.10 mass % to not more than 5.00 mass % with respect to a total amount of the magnetic toner.

Advantageous Effects of Invention

The present invention can provide a magnetic toner that, regardless of the environment, gives a high image density and exhibits an excellent transferability.

DESCRIPTION OF EMBODIMENTS

The magnetic toner of the present invention is a magnetic toner comprising: magnetic toner particles comprising a binder resin and a magnetic body; and inorganic fine particles that are present on the surface of the magnetic toner particles and are not a magnetic iron oxide and magnetic iron oxide particles that are present on the surface of the magnetic toner particles, wherein;

the inorganic fine particles present on the surface of the magnetic toner particles comprise metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein;

when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the magnetic toner has a coverage ratio A of at least 45.0% and not more than 70.0% and a ratio [coverage ratio B/coverage ratio A] of the coverage ratio B to the coverage ratio A of at least 0.50 and not more than 0.85, and wherein;

the magnetic iron oxide particles present on the surface of the magnetic toner particles are from at least 0.10 mass % to not more than 5.00 mass % with respect to a total amount of the magnetic toner.

Figure 1:
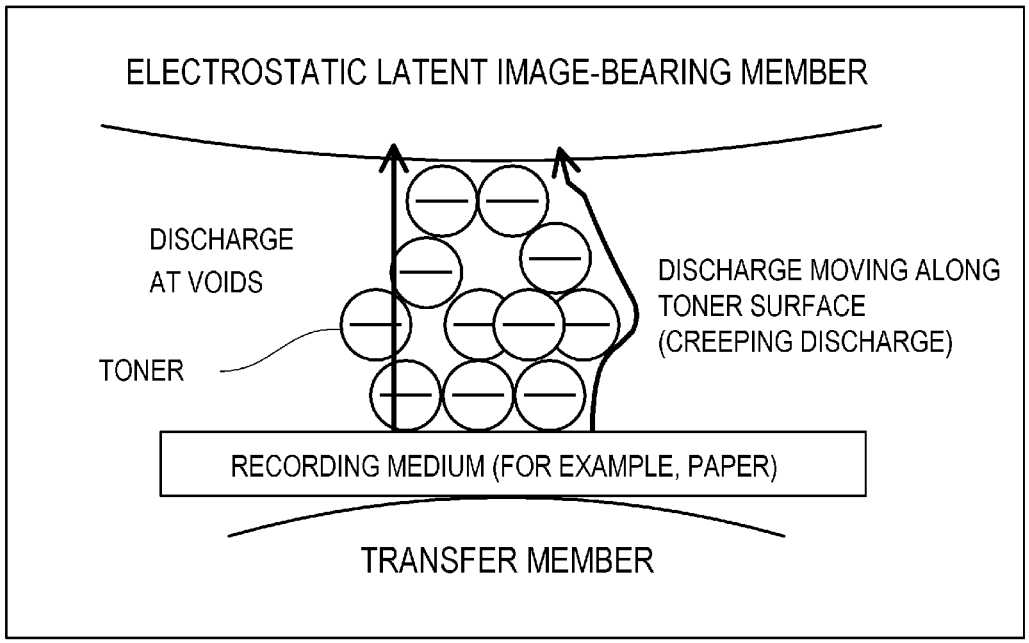
FIG. 1 is a diagram that shows the status of the magnetic toner between the electrostatic latent image-bearing member and the recording medium.

The status of the magnetic toner between the electrostatic latent image-bearing member and the recording medium is shown in FIG. 1. In FIG. 1, the magnetic toner is negatively charged and a positive bias is applied to the transfer material. When the state of the magnetic toner layer is as shown in FIG. 1, discharge readily occurs during transfer due to the many voids. In addition, a creeping discharge moving along the surface of the magnetic toner layer is also thought to occur. When discharge occurs and the magnetic toner receives a large current, the magnetic toner easily becomes an inversion component due to disruption of the charge on the magnetic toner and a "re-transfer"—in which the magnetic toner on the recording medium returns onto the electrostatic latent image-bearing member—ends up occurring. For example, when re-transfer occurs frequently during the output of a solid black image, transfer defects become prominent and a non-uniform image ends up being produced.

Due to this, both the discharge occurring at the voids and the creeping discharge moving along the surface of the magnetic toner layer must be suppressed in order to prevent transfer defects.

With regard to the discharge occurring at the voids, the voids themselves in the magnetic toner layer must be reduced. When the voids are considered, the voids will naturally be reduced when the magnetic toner is tightly packed. In order to bring this about, aggregation-induced deviations must be reduced by eliminating the forces that act between the magnetic toner as much as possible. Here, the forces mediating magnetic toner aggregation are thought to be [1] a nonelectrostatic force, i.e., van der Waals force, and [2] an electrostatic force.

First of all, with respect to the [1] van der Waals force, the van der Waals force (F) produced between a flat plate and a particle is shown by the following formula.

$$F=H\times D/12Z^2$$

Here, H is Hamaker's constant, D is the diameter of the particle, and Z is the distance between the particle and the flat plate.

With respect to Z, it is generally held that an attractive force operates at large distances and a repulsive force operates at very small distances, and Z is treated as a constant since it is unrelated to the state of the magnetic toner particle surface.

According to the preceding equation, the van der Waals force (F) is proportional to the diameter of the particle in contact with the flat plate. When this is applied to the magnetic toner surface, the van der Waals force (F) is smaller for an inorganic fine particle, with its smaller particle size, in contact with the flat plate than for a magnetic toner particle in contact with the flat plate. That is, considering the particle-to-particle case based on the particle-and-flat plate model, the van der Waals force operating between particles is smaller for contact through the intermediary of the inorganic fine particles than for direct contact between magnetic toner particles.

Furthermore, with regard to the electrostatic force [2], the electrostatic force can be regarded as a reflection force. It is known that a reflection force generally is directly proportional to the square of the particle charge (q) and inversely proportional to the square of the distance.

When the charging of a magnetic toner is considered, the charge held by the magnetic toner particle surface is thought to account for the majority of the total amount of charge on the magnetic toner. In other words, it is the surface of the magnetic toner particle and not the inorganic fine particles that bear the charge. Due to this, the reflection force declines as the distance from the magnetic toner particle surface grows, as does the van der Waals force, and the reflection force is thus smaller for contact through the intermediary of the inorganic fine particles than for direct contact between the magnetic toner particles.

Whether the magnetic toner particles are in direct contact with each other or are in contact with each other through the intermediary of the inorganic fine particles, depends on the amount of inorganic fine particles coating the magnetic toner particle surface, i.e., on the coverage ratio by the inorganic fine particles. This then imposes the necessity of considering the coverage ratio of the inorganic fine particles on the magnetic toner particles' surface. It is thought that the opportunity for direct contact between the magnetic toner particles is diminished at a high coverage ratio by the inorganic fine particles, which makes it more difficult for the magnetic toner to aggregate with itself. On the other hand, when the inorganic fine particles exhibit a low coverage ratio, aggregation readily occurs due to contact between the magnetic toner particles, and, due to the appearance of deviations within the magnetic toner layer, voids are produced and discharge cannot be prevented.

With regard, on the other hand, to the coverage ratio by the inorganic fine particles, a theoretical coverage ratio can be calculated—making the assumption that the inorganic fine particles and the magnetic toner have a spherical shape—using the equation described, for example, in Patent Literature 5. However, there are also many instances in which the inorganic fine particles and/or the magnetic toner do not have a spherical shape, and in addition the inorganic fine particles generally may be present in an aggregated state at the magnetic toner particle surface. As a consequence, the theoretical coverage ratio derived using the indicated technique is not germane to the transferability.

Proceeding as described in detail below, the present inventors therefore carried out observation of the magnetic toner surface with the scanning electron microscope (SEM) and determined the proportion of actual coverage of the magnetic toner particle surface by the inorganic fine particles, i.e., the coverage ratio.

Figure 3:
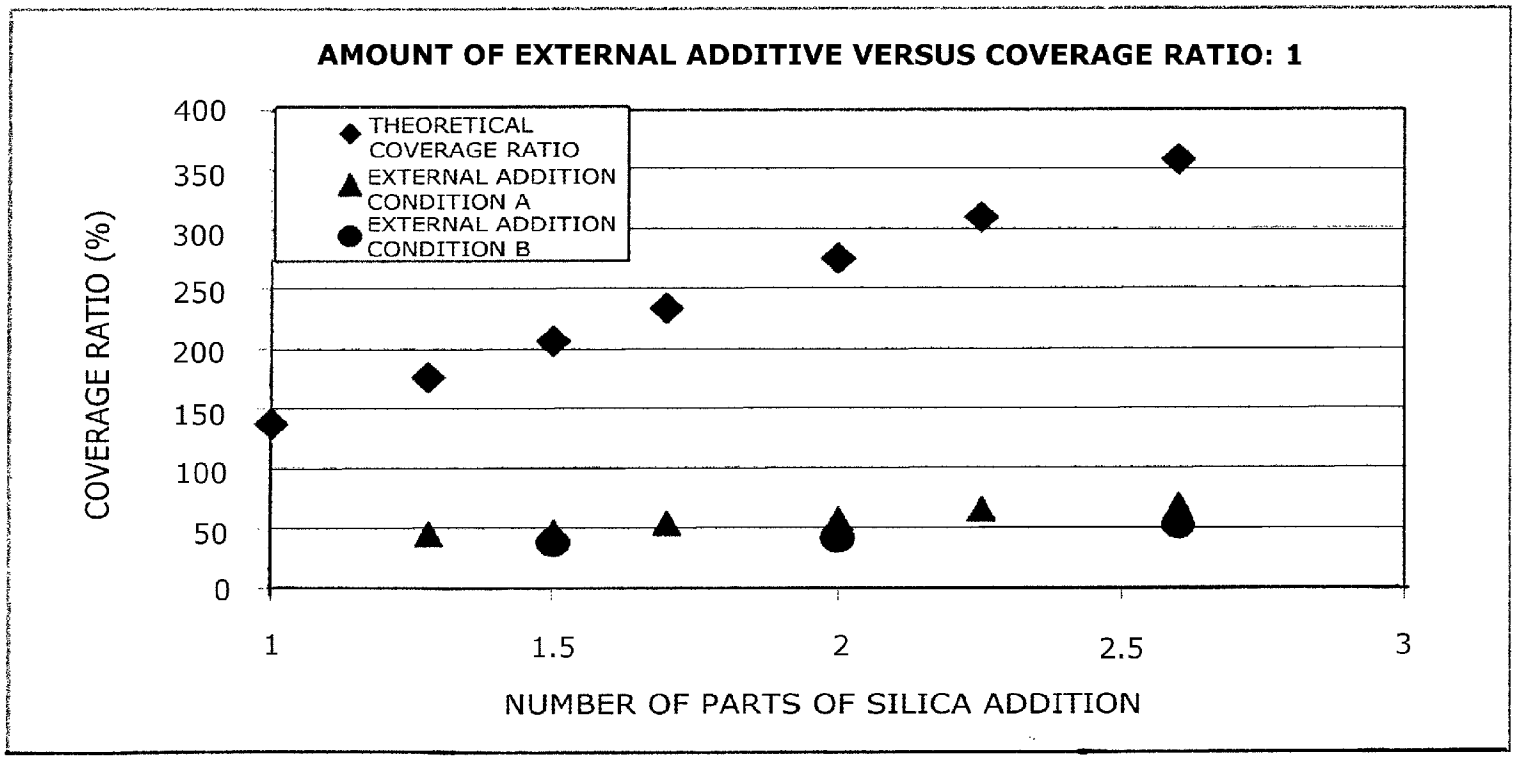
FIG. 3 is a diagram that shows an example of the relationship between the number of parts of silica addition and the coverage ratio.
Figure 4:
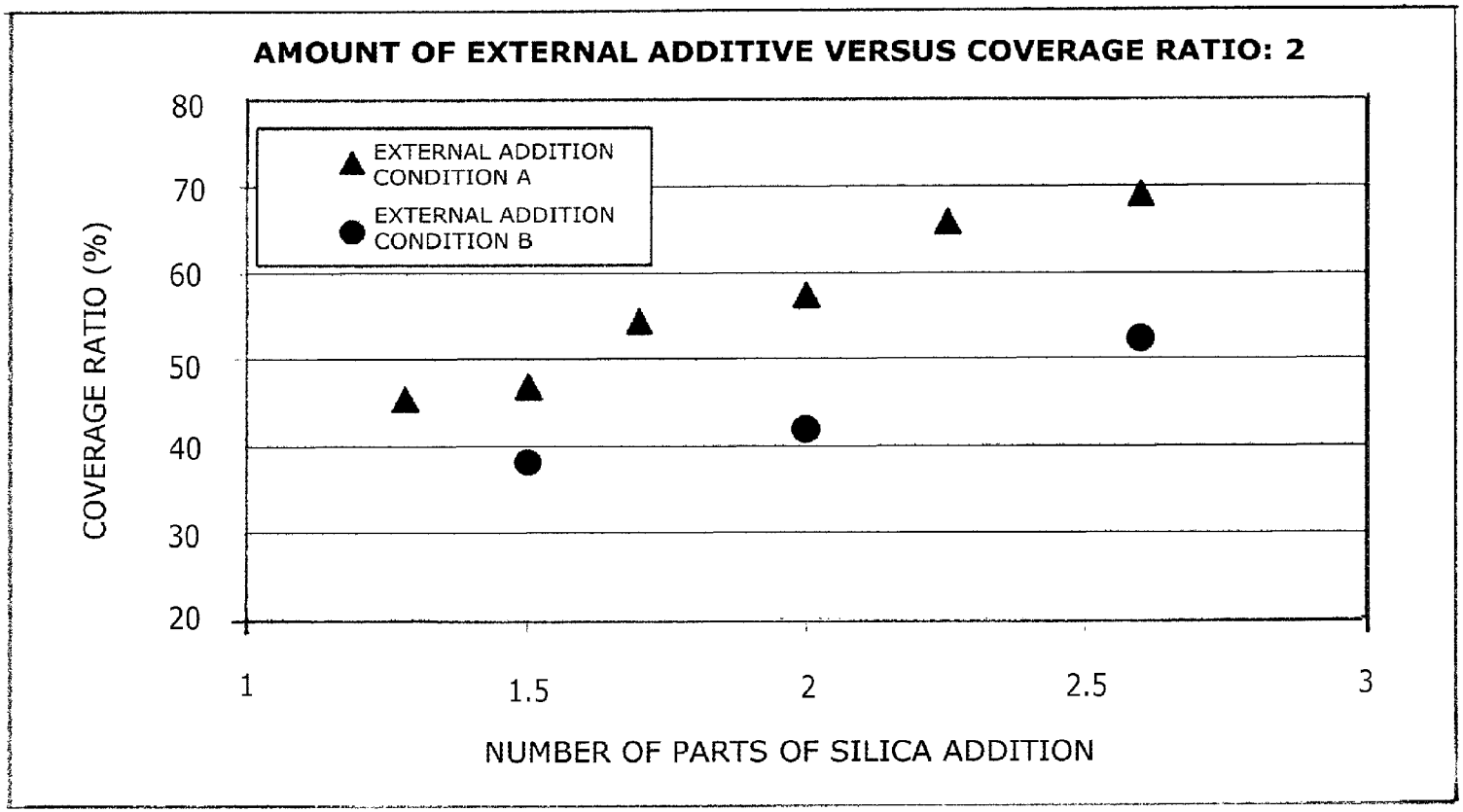
FIG. 4 is a diagram that shows an example of the relationship between the number of parts of silica addition and the coverage ratio.

As one example, the theoretical coverage ratio and the actual coverage ratio were determined for mixtures prepared by adding different amounts of silica fine particles (number of parts of silica addition to 100 mass parts of magnetic toner particles) to the magnetic toner particles (magnetic body content being 43.5 mass %) by a pulverization method, with a volume-average particle diameter (Dv) being 8.0 μm (refer to FIGS. 3 and 4). Silica fine particles with a volume-average particle diameter (Dv) of 15 nm were used for the silica fine particles. For the calculation of the theoretical coverage ratio, 2.2 g/cm$^3$ was used for the true specific gravity of the silica fine particles; 1.65 g/cm$^3$ was used for the true specific gravity of the magnetic toner; and monodisperse particles with a particle diameter of 15 nm and 8.0 μm were assumed for, respectively, the silica fine particles and the magnetic toner particles.

As shown in FIG. 3, the theoretical coverage ratio exceeds 100% as the amount of addition of the silica fine particles is increased. On the other hand, the coverage ratio obtained by actual observation does vary with the amount of addition of the silica fine particles, but does not exceed 100%. This is due to silica fine particles being present to some degree as aggregates on the magnetic toner surface or is due to a large effect from the silica fine particles not being spherical.

Moreover, according to investigations by the present inventors, it was found that, even at the same amount of addition by the silica fine particles, the coverage ratio varied with the external addition technique. That is, it is not possible to determine the coverage ratio uniquely from the amount of addition of the silica fine particles (refer to FIG. 4). Here, external addition condition A refers to mixing at 1.0 W/g for a processing time of 5 minutes using the apparatus shown in FIG. 6. External addition condition B refers to mixing at 4000 rpm for a processing time of 2 minutes using an FM10C Henschel mixer (from Mitsui Miike Chemical Engineering Machinery Co., Ltd.).

For the reasons provided in the preceding, the present inventors used the inorganic fine particle coverage ratio obtained by SEM observation of the magnetic toner surface.

As has been described to this point, it is thought that the voids in the magnetic toner layer can be reduced by inhibiting aggregation between magnetic toner particles by raising the coverage ratio by the inorganic fine particles. The coverage ratio by the inorganic fine particles and the void ratio in the magnetic toner were therefore investigated.

In order to determine the void ratio, the magnetic toner is first introduced into a cup of known capacity and mass, with the magnetic toner being introduced according to, at least, this capacity, and the magnetic toner is brought into a consolidated state by tapping a prescribed number of times. After this, the magnetic toner in excess of the capacity is removed and the density per unit volume is measured for the consolidated magnetic toner. The void ratio of the magnetic toner layer can be calculated from this.

Figure 5:
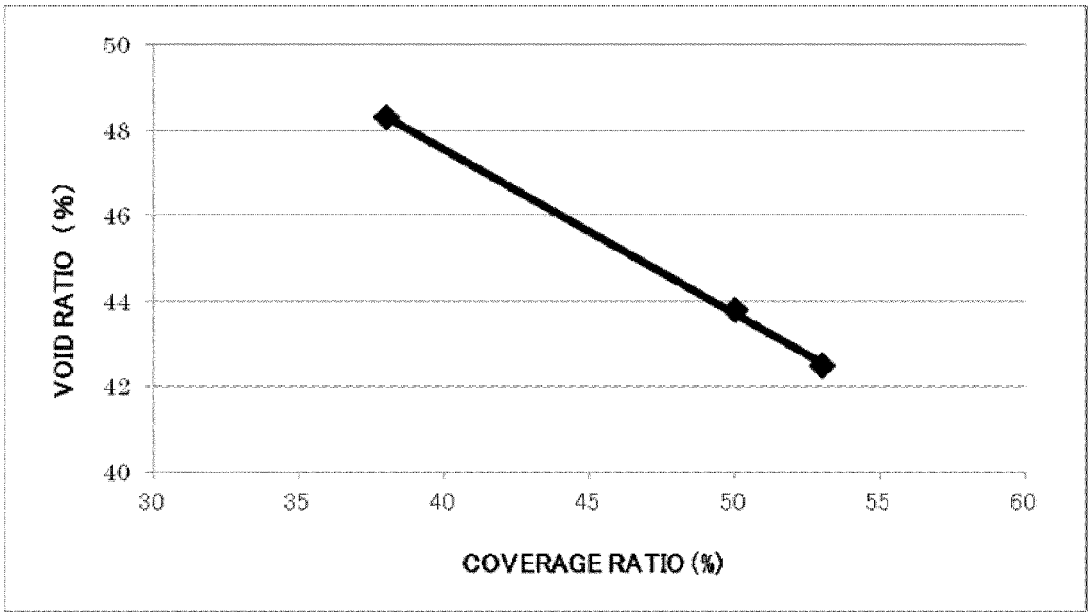
FIG. 5 is a diagram that shows the relationship between the coverage ratio and the void ratio.

This measurement was performed on individual magnetic toners having different coverage ratios. The relationship between the coverage ratio and the void ratio is shown in FIG. 5. The void ratio determined by this procedure is thought to correlate with the state of the magnetic toner layer residing between the electrostatic latent image-being member and the recording medium, and, as is clear from FIG. 5, the void ratio is shown to be smaller at a higher coverage ratio by the inorganic fine particles.

Even if these voids were to be made nonexistent, this would not stop creeping discharge along the surface of the magnetic toner layer and in particular it would be quite difficult to stop transfer defects in environments where discharge is prone to occur.

Figure 2:
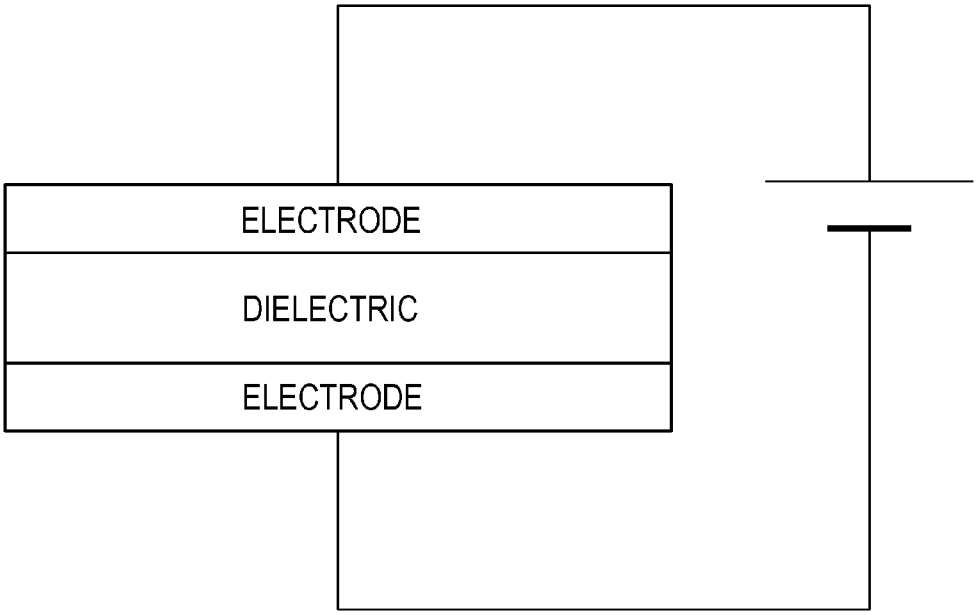
FIG. 2 is a diagram that shows a model of a capacitor.

Considering this discharge further, and letting C be the capacitance of the dielectric between electrodes in the capacitor model in FIG. 2, C is then given by the following formula.

$$C=\in S/d$$

(S represents the area of a single electrode plate, d represents the distance between the electrode plates, and ∈ represents the dielectric constant of the dielectric between the electrode plates.)

Discharge is produced between the electrodes when a large electric field is applied between the electrodes and the dielectric in FIG. 2 has a low capacitance. According to the formula given above, the capacitance is proportional to the dielectric constant of the material. Accordingly, it can be expected that the frequency of discharge will be lowered in the case of a material with a high capacitance. Based on this, the present inventors carried out focused investigations with regard to high-capacitance materials and as a result found that a significant effect is present when magnetic iron oxide particles are present on the surface. It is thought that this occurs because creeping discharge moving along the surface of the magnetic toner layer is inhibited by the presence of high-capacitance magnetic iron oxide particles on the surface.

When the present inventors carried out focused investigations based on the preceding results, the transferability could be improved by, with regard to the coverage ratio of the magnetic toner particles' surface by the inorganic fine particles, having the coverage ratio A be at least 45.0% and controlling the above-described B/A and by having the magnetic iron oxide particles present on the surface of the magnetic toner particles be from at least 0.10 mass % to not more than 5.00 mass % with respect to the total amount of the magnetic toner. The reasons for this are thought to be as follows.

First, with regard to the coverage ratio A, as noted above a higher coverage ratio results in a lower void ratio for the magnetic toner layer. Due to this, it is thought that, when the coverage ratio A is at least 45%, the voids within the magnetic toner layer present between the electrostatic latent image-bearing member and the recording medium are reduced and the discharge occurring at the voids is then suppressed. On the other hand, the inorganic fine particles must be added in large amounts in order to bring the coverage ratio A above 70.0%, but, even if an external addition method could be devised here, image defects, for example, vertical streaks, brought about by released inorganic fine particles are then readily produced and this is therefore disfavored.

When, on the other hand, the coverage ratio A by the inorganic fine particles is smaller than 45.0%, a large void ratio ends up occurring and the transferability is not improved. The coverage ratio A is preferably from at least 45.0% to not more than 65.0%.

In addition, B/A is from at least 0.50 to not more than 0.85. That B/A is from at least 0.50 to not more than 0.85 means that inorganic fine particles fixed to the magnetic toner particles' surface are present to a certain degree and that in addition inorganic fine particles are also present in a state that enables behavior separated from the magnetic toner. Considering the magnetic toner layer present between the electrostatic latent image-bearing member and the recording medium, this magnetic toner layer resides in a state in which pressure has been applied to a certain degree. Here, it is thought that the magnetic toner can freely rotate, even when pressure has been applied to a certain degree, due to the presence of inorganic fine particles fixed to the magnetic toner particles' surface and the presence of inorganic fine particles capable of behaving separately from the magnetic toner particle. It is believed that this is due to the generation of a bearing-like effect by the releasable inorganic fine particles sliding against the inorganic fine particles fixed to the magnetic toner particles' surface. For this reason, the magnetic toner of the present invention resides in a state in which the void ratio in the magnetic toner layer readily assumes small values and even when pressure is applied free rotation of the magnetic toner is possible, and due to this the voids in the magnetic toner layer between the electrostatic latent image-bearing member and recording medium can be maximally reduced through a further tight packing. B/A is preferably from at least 0.55 to not more than 0.80.

The magnetic iron oxide particles present on the surface of the magnetic toner particles are from at least 0.10 mass % to not more than 5.00 mass %, expressed with respect to the total amount of the magnetic toner, in the magnetic toner of the present invention. When, in addition to controlling the coverage ratio A and B/A as described above, at least 0.10 mass % magnetic iron oxide particles are present on the magnetic toner particles' surface, creeping discharge along the surface of the magnetic toner layer is substantially inhibited and the transferability is dramatically improved. When, on the other hand, the magnetic iron oxide particle content exceeds 5.00 mass %, the magnetic iron oxide particles are then present in excess and the members are subject to abrasion by released magnetic iron oxide particles and the image density of solid black images undergoes a substantial decline due to, for example, the production of white streaks. When the magnetic iron oxide particle content is below 0.10 mass %, creeping discharge is not inhibited and there is a substantial worsening of the transfer defects. This magnetic iron oxide particle content is preferably from at least 0.30 mass % to not more than 5.00 mass %.

As has been described to this point, the magnetic toner of the present invention—by eliminating the voids in the magnetic toner layer that resides between the electrostatic latent image-bearing member and the recording medium and by placing a prescribed amount of magnetic iron oxide particles on the magnetic toner particles' surface—can provide an effective inhibition of creeping discharge and discharge at the voids during transfer and can thus provide a substantial improvement in the transferability.

In addition, the coefficient of variation on the coverage ratio A is preferably not more than 10.0% in the present invention. As has been described to this point, the coverage ratio A correlates with the void ratio of the magnetic toner layer. A coefficient of variation on the coverage ratio A of not more than 10.0% means that the coverage ratio A is very uniform both between magnetic toner particles and within a magnetic toner particle. A more uniform coverage ratio A enables the development of the aforementioned bearing effect with less particle-to-particle variation. Due to this, the magnetic toner layer between the electrostatic latent image-bearing member and the recording medium will be tightly packed without unevenness and as a consequence the voids will be favorably reduced. The coefficient of variation on the coverage ratio A is more preferably not more than 8.0%.

In addition, there are no particular limitations on the technique for bringing the coefficient of variation on the coverage ratio A to 10.0% or less, but the use is preferred of the external addition apparatus and technique described below, which are capable of bringing about a high degree of spreading of the metal oxide fine particles, e.g., silica fine particles, over the magnetic toner particles' surface.

The magnetic toner of the present invention preferably has a dielectric constant $\in'$ at a frequency of 100 kHz and a temperature of 40° C. of at least 40.0 pF/m. A frequency of 100 kHz is specified here as the basis for measuring the dielectric constant $\in'$ because this is a favorable frequency for performing the stable measurement of the dielectric constant $\in'$ of a magnetic toner. In addition, the temperature of 40° C. is assumed to be the temperature when the interior of a printer has heated up during continuous use of the printer.

The reason for the additional improvement in the transferability when the dielectric constant $\in'$ is at least 40.0 pF/m is thought to be as follows. As previously described, the discharge during transfer must be suppressed in order to raise the transferability. On the supposition that, in the capacitor model, the electrodes are the electrostatic latent-image bearing member and the recording medium and magnetic toner layer is the dielectric, the occurrence of discharge is impeded when the capacitance of the dielectric is raised. Based on the formula for the capacitance, a higher dielectric constant for the dielectric provides a higher capacitance. Accordingly, it is thought that, when the dielectric constant ∈' of the magnetic toner layer is raised, the capacitance is also raised and the transferability is improved due to an impairment of the occurrence of discharge. Due to this, the dielectric constant ∈' of the magnetic toner is preferably at least 40.0 pF/m in the present invention. This dielectric constant ∈' is more preferably from at least 43.0 pF/m to not more than 50.0 pF/m.

This dielectric constant ∈' can be brought into the range indicated above by adjusting the amount of addition of the magnetic body.

The magnetic toner of the present invention preferably has an average circularity of from at least 0.935 to not more than 0.955. An average circularity from at least 0.935 to not more than 0.955 means that the magnetic toner is irregular and unevenness is present. In general, a higher average circularity results in a higher flowability for the magnetic toner. When the van der Waals force is reconsidered here, D is the particle diameter of the magnetic toner and is also considered in actuality to be the radius of curvature of the region in contact with the flat plate. Due to this, an irregular toner provided with a smaller radius of curvature readily provides a smaller van der Waals force and the present inventors believe that the effects of the present invention can then be even more favorably manifested. This average circularity can be adjusted into the indicated range by adjusting the method of producing the magnetic toner and by adjusting the production conditions.

The binder resin for the magnetic toner in the present invention can be exemplified by vinyl resins, polyester resins, and so forth, but there is no particular limitation thereon and the heretofore known resin can be used.

In specific terms, the following, for example, can be used: polystyrene; styrene copolymers such as styrene-propylene copolymers, styrene-vinyltoluene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-octyl methacrylate copolymers, styrene-butadiene copolymers, styrene-isoprene copolymers, styrene-maleic acid copolymers, and styrene-maleate copolymers; polyacrylate esters; polymethacrylate esters; and polyvinyl acetate. A single one of these may be used or a plurality may be used in combination. Among the preceding, styrene copolymers and polyester resins are preferred from the standpoint of the developing characteristics and the fixing performance.

The glass-transition temperature (Tg) of the magnetic toner of the present invention is preferably from at least 40° C. to not more than 70° C. When the glass-transition temperature of the magnetic toner is from at least 40° C. to not more than 70° C., the storage stability and durability can be enhanced while maintaining a favorable fixing performance.

A charge control agent is preferably added to the magnetic toner of the present invention.

Organometal complex compounds and chelate compounds are effective as charging agents for negative charging and can be exemplified by monoazo-metal complex compounds; acetylacetone-metal complex compounds; and metal complex compounds of aromatic hydroxycarboxylic acids and aromatic dicarboxylic acids. Specific examples of commercially available products are Spilon Black TRH, T-77, and T-95 (Hodogaya Chemical Co., Ltd.) and BONTRON (registered trademark) S-34, S-44, S-54, E-84, E-88, and E-89 (Orient Chemical Industries Co., Ltd.).

A single one of these charge control agents may be used or two or more may be used in combination. Considered from the standpoint of the amount of charging of the magnetic toner, these charge control agents are used, expressed per 100 mass parts of the binder resin, preferably at from 0.1 to 10.0 mass parts and more preferably at from 0.1 to 5.0 mass parts.

The magnetic toner of the present invention may as necessary also incorporate a release agent in order to improve the fixing performance. Any known release agent can be used for this release agent. Specific examples are petroleum waxes, e.g., paraffin wax, microcrystalline wax, and petrolatum, and their derivatives; montan waxes and their derivatives; hydrocarbon waxes provided by the Fischer-Tropsch method and their derivatives; polyolefin waxes, as typified by polyethylene and polypropylene, and their derivatives; natural waxes, e.g., carnauba wax and candelilla wax, and their derivatives; and ester waxes. Here, the derivatives include oxidized products, block copolymers with vinyl monomers, and graft modifications. In addition, the ester wax can be a monofunctional ester wax or a multifunctional ester wax, e.g., most prominently a difunctional ester wax but also a tetrafunctional or hexafunctional ester wax.

When a release agent is used in the magnetic toner of the present invention, its content is preferably from at least 0.5 mass parts to not more than 10 mass parts per 100 mass parts of the binder resin. When the release agent content is in the indicated range, the fixing performance is enhanced while the storage stability of the magnetic toner is not impaired.

The release agent can be incorporated in the binder resin by, for example, a method in which, during resin production, the resin is dissolved in a solvent, the temperature of the resin solution is raised, and addition and mixing are carried out while stirring, or a method in which addition is carried out during melt kneading during production of the magnetic toner.

The peak temperature (also referred to below as the melting point) of the maximum endothermic peak measured on the release agent using a differential scanning calorimeter (DSC) is preferably from at least 60° C. to not more than 140° C. and more preferably is from at least 70° C. to not more than 130° C. When the peak temperature (melting point) of the maximum endothermic peak is from at least 60° C. to not more than 140° C., the magnetic toner is easily plasticized during fixing and the fixing performance is enhanced. This is also preferred because it works against the appearance of exudation by the release agent even during long-term storage.

The peak temperature of the maximum endothermic peak of the release agent is measured in the present invention based on ASTM D3418-82 using a "Q1000" differential scanning calorimeter (TA Instruments, Inc.). Temperature correction in the instrument detection section is carried out using the melting points of indium and zinc, while the heat of fusion of indium is used to correct the amount of heat.

Specifically, approximately 10 mg of the measurement sample is precisely weighed out and this is introduced into an aluminum pan. Using an empty aluminum pan as the reference, the measurement is performed at a rate of temperature rise of 10° C./min in the measurement temperature range from 30 to 200° C. For the measurement, the temperature is raised to 200° C. and is then dropped to 30° C. at 10° C./min and is thereafter raised again at 10° C./min. The peak temperature of the maximum endothermic peak is determined for the release agent from the DSC curve in the temperature range of 30 to 200° C. for this second temperature ramp-up step.

The magnetic toner of the present invention contains a magnetic body in the interior of the magnetic toner particle and additionally contains magnetic iron oxide particles on the surface of the magnetic toner particle. Here, the magnetic iron oxide particles are placed on the surface of the magnetic toner particle by external addition to the magnetic toner particles.

The magnetic body present in the interior of the magnetic toner particles can be exemplified by iron oxides such as magnetite, maghemite, ferrite, and so forth; metals such as iron, cobalt, and nickel; and alloys and mixtures of these metals with metals such as aluminum, copper, magnesium, tin, zinc, beryllium, calcium, manganese, selenium, titanium, tungsten, and vanadium.

With regard to the magnetic characteristics of this magnetic body for the application of 79.6 kA/m, the coercive force (Hc) is preferably from 1.6 to 12.0 kA/m. The intensity of magnetization (σs) is preferably from 30 to 90 $Am^2/kg$ and more preferably is from 40 to 80 $Am^2/kg$. The residual magnetization (σr) is preferably from 1.0 to 10.0 $Am^2/kg$ and more preferably is from 1.5 to 8.0 $Am^2/kg$.

Any shape can be used for the shape of the magnetic body, but an at least tetrahedral polyhedron is preferred and an octahedron is more preferred.

On the other hand, the magnetic iron oxide particles present on the magnetic toner particles' surface can be, for example, of a similar substance as the magnetic body present in the interior of the magnetic toner particles. The shape of the magnetic iron oxide particle can be exemplified by octahedral, hexahedral, spherical, acicular, scale-shaped, and so forth, and, while any shape can be used, an at least tetrahedral polyhedron is preferred and an octahedron is more preferred.

The number-average particle diameter (D1) of the primary particles of this magnetic body is preferably not more than 0.50 μm and more preferably is from 0.05 μm to 0.30 μm.

The number-average particle diameter (D1) of the primary particles of the magnetic iron oxide particles is preferably from at least 0.05 μm to not more than 0.30 μm, because this facilitates uniform attachment in the primary particle state to the magnetic toner particles' surface in the external addition step and tends to reduce the fogging. From at least 0.10 μm to not more than 0.30 μm is more preferred.

Moreover, with regard to the magnetic characteristics of this magnetic iron oxide particle for the application of 79.6 kA/m, a coercive force (Hc) of from 1.6 to 25.0 kA/m is preferred because this tends to raise the developing performance. From 15.0 to 25.0 kA/m is more preferred. A intensity of magnetization ($\sigma_s$) is preferably from 30 to 90 $Am^2/kg$ and more preferably from 40 to 80 $Am^2/kg$; and a residual magnetization ($\sigma_r$) is preferably from 1.0 to 10.0 $Am^2/kg$ and more preferably from 1.5 to 8.0 $Am^2/kg$.

The magnetic toner of the present invention preferably contains from at least 35 mass % to not more than 50 mass % of the magnetic body in the interior of the magnetic toner particle and more preferably contains from at least 40 mass % to not more than 50 mass %.

When the content of the magnetic body is less than 35 mass %, the magnetic attraction to the magnet roll within a developing sleeve declines and fogging may be exacerbated. When, on the other hand, the magnetic body content exceeds 50 mass %, the density may decline due to a decline in the developing performance.

The content of the magnetic body in the interior of the magnetic toner particle can be measured using, for example, a Q5000IR TGA thermal analyzer from PerkinElmer Inc. after removing by rinsing the magnetic body present on the surface. With regard to the measurement method, the magnetic toner is heated from normal temperature to 900° C. under a nitrogen atmosphere at a rate of temperature rise of 25° C./minute: the mass loss from 100 to 750° C. is taken to be the component provided by subtracting the magnetic body from the magnetic toner and the residual mass is taken to be the amount of the magnetic body.

On the other hand, the method of measuring the amount of magnetic iron oxide particles present at the magnetic toner particles' surface is described below.

The aforementioned magnetic characteristics of the magnetic body and the magnetic iron oxide particles are measured in the present invention at a room temperature of 25° C. and an external magnetic field of 79.6 kA/m using a VSM P-1-10 vibrating sample magnetometer (Toei Industry Co., Ltd.).

The magnetic toner of the present invention contains inorganic fine particles, which are not a magnetic iron oxide, on the magnetic toner particles' surface. The inorganic fine particles present on the magnetic toner particles' surface can be exemplified by silica fine particles, titania fine particles, and alumina fine particles, and these inorganic fine particles can also be favorably used after the execution of a hydrophobic treatment on the surface thereof.

It is critical that the inorganic fine particles present on the surface of the magnetic toner particles in the present invention contain at least one of metal oxide fine particle selected from the group consisting of silica fine particles, titania fine particles, and alumina fine particles, and that at least 85 mass % of the metal oxide fine particles be silica fine particles. Preferably at least 90 mass % of the metal oxide fine particles are silica fine particles.

The reasons for this are that silica fine particles not only provide the best balance with regard to imparting charging performance and flowability, but are also excellent from the standpoint of lowering the aggregative forces between the magnetic toners.

The reason why silica fine particles are excellent from the standpoint of lowering the aggregative forces between the toners are not entirely clear, but it is hypothesized that this is probably due to the substantial operation of the previously described bearing effect with regard to the sliding behavior between the silica fine particles.

In addition, silica fine particles are preferably the main component of the inorganic fine particles fixed to the magnetic toner particle surface. Specifically, the inorganic fine particles fixed to the magnetic toner particle surface preferably contain at least one of metal oxide fine particle selected from the group consisting of silica fine particles, titania fine particles, and alumina fine particles wherein silica fine particles are at least 80 mass % of these metal oxide fine particles. The silica fine particles are more preferably at least 90 mass %. This is hypothesized to be for the same reasons as discussed above: silica fine particles are the best from the standpoint of imparting charging performance and flowability, and as a consequence a rapid initial rise in magnetic toner charge occurs. The result is that a reduction in fogging and a high image density can be obtained, which is strongly preferred.

Here, the timing and amount of addition of the inorganic fine particles may be adjusted in order to bring the silica fine particles to at least 85 mass % of the metal oxide fine particles present on the magnetic toner particle surface and in order to also bring the silica fine particles to at least 80 mass % with reference to the metal oxide particles fixed on the magnetic toner particle surface.

The amount of inorganic fine particles present can be checked using the methods described below for quantitating the inorganic fine particles.

The number-average particle diameter (D1) of the primary particles in the inorganic fine particles in the present invention is preferably from at least 5 nm to not more than 50 nm and more preferably is from at least 10 nm to not more than 35 nm.

Bringing the number-average particle diameter (D1) of the primary particles in the inorganic fine particles into the indicated range makes it easier to control of the coverage ratio A and B/A and facilitates the generation of the above-described bearing effect and attachment force-reducing effect. When the primary particle number-average particle diameter (D1) is less than 5 nm, the inorganic fine particles tend to aggregate with one another and obtaining a large value for B/A becomes problematic and the coefficient of variation on the coverage ratio A is also prone to assume large values. When, on the other hand, the primary particle number-average particle diameter (D1) exceeds 50 nm, the coverage ratio A is prone to be small even at large amounts of addition of the inorganic fine particles; in addition, B/A will also tend to have a low value because it becomes difficult for the inorganic fine particles to be fixed to the magnetic toner particles. That is, it is difficult to obtain the above-described void ratio reducing effect and bearing effect when the primary particle number-average particle diameter (D1) is greater than 50 nm.

A hydrophobic treatment is preferably carried out on the inorganic fine particles used in the present invention, and particularly preferred inorganic fine particles will have been hydrophobically treated to a hydrophobicity, as measured by the methanol titration test, of at least 40% and more preferably at least 50%.

The method for carrying out the hydrophobic treatment can be exemplified by methods in which treatment is carried out with, e.g., an organosilicon compound, a silicone oil, a long-chain fatty acid, and so forth.

The organosilicon compound can be exemplified by hexamethyldisilazane, trimethylsilane, trimethylethoxysilane, isobutyltrimethoxysilane, trimethylchlorosilane, dimethyldichlorosilane, methyltrichlorosilane, dimethylethoxysilane, dimethyldimethoxysilane, diphenyldiethoxysilane, and hexamethyldisiloxane. A single one of these can be used or a mixture of two or more can be used.

The silicone oil can be exemplified by dimethylsilicone oil, methylphenylsilicone oil, α-methylstyrene-modified silicone oil, chlorophenyl silicone oil, and fluorine-modified silicone oil.

A $C_{10-22}$ fatty acid is suitably used for the long-chain fatty acid, and the long-chain fatty acid may be a straight-chain fatty acid or a branched fatty acid. A saturated fatty acid or an unsaturated fatty acid may be used.

Among the preceding, $C_{10-22}$ straight-chain saturated fatty acids are highly preferred because they readily provide a uniform treatment of the surface of the inorganic fine particles.

These straight-chain saturated fatty acids can be exemplified by capric acid, lauric acid, myristic acid, palmitic acid, stearic acid, arachidic acid, and behenic acid.

Inorganic fine particles that have been treated with silicone oil are preferred for the inorganic fine particles used in the present invention, and inorganic fine particles treated with an organosilicon compound and a silicone oil are more preferred. This makes possible a favorable control of the hydrophobicity.

The method for treating the inorganic fine particles with a silicone oil can be exemplified by a method in which the silicone oil is directly mixed, using a mixer such as a Henschel mixer, with inorganic fine particles that have been treated with an organosilicon compound, and by a method in which the silicone oil is sprayed on the inorganic fine particles. Another example is a method in which the silicone oil is dissolved or dispersed in a suitable solvent; the inorganic fine particles are then added and mixed; and the solvent is removed.

In order to obtain a good hydrophobicity, the amount of silicone oil used for the treatment, expressed per 100 mass parts of the inorganic fine particles, is preferably from at least 1 mass parts to not more than 40 mass parts and is more preferably from at least 3 mass parts to not more than 35 mass parts.

In order to impart an excellent flowability to the magnetic toner, the silica fine particles, titania fine particles, and alumina fine particles used by the present invention have a specific surface area as measured by the BET method based on nitrogen adsorption (BET specific surface area) preferably of from at least 20 $m^2/g$ to not more than 350 $m^2/g$ and more preferably of from at least 25 $m^2/g$ to not more than 300 $m^2/g$.

Measurement of the specific surface area (BET specific surface area) by the BET method based on nitrogen adsorption is performed based on JIS 28830 (2001). A "TriStar300 (Shimadzu Corporation) automatic specific surface area—pore distribution analyzer", which uses gas adsorption by a constant volume technique as its measurement procedure, is used as the measurement instrument.

The amount of addition of the inorganic fine particles, expressed per 100 mass parts of the magnetic toner particles, is preferably from at least 1.5 mass parts to not more than 3.0 mass parts of the inorganic fine particles, more preferably from at least 1.5 mass parts to not more than 2.6 mass parts, and even more preferably from at least 1.8 mass parts to not more than 2.6 mass parts.

Setting the amount of addition of the inorganic fine particles in the indicated range is also preferred from the standpoint of facilitating appropriate control of the coverage ratio A and B/A and also from the standpoint of the image density and fogging. Exceeding 3.0 mass parts for the amount of addition of the inorganic fine particles, even if an external addition apparatus and an external addition method could be devised, gives rise to release of the inorganic fine particles and facilitates the appearance of, for example, a streak on the image.

In addition to the above-described inorganic fine particles, particles with a primary particle number-average particle diameter (D1) of from at least 80 nm to not more than 3 μm may be added to the magnetic toner of the present invention. For example, a lubricant, e.g., a fluororesin powder, zinc stearate powder, or polyvinylidene fluoride powder; a polish, e.g., a cerium oxide powder, a silicon carbide powder, or a strontium titanate powder; or a spacer particle such as silica and resin particle, may also be added in small amounts that do not influence the effects of the present invention.

Examples of methods for producing the magnetic toner of the present invention are provided below, but there is no intent to limit the production method to these.

The magnetic toner of the present invention can be produced by any known method that enables adjustment of the coverage ratio A and B/A and that preferably has a step in which the average circularity can be adjusted, while the other production steps are not particularly limited.

The following method is a favorable example of such a production method. First, the binder resin and magnetic body and as necessary other raw materials, e.g., a release agent and a charge control agent, are thoroughly mixed using a mixer such as a Henschel mixer or ball mill and are then melted, worked, and kneaded using a heated kneading apparatus such as a roll, kneader, or extruder to compatibilize the resins with each other.

The obtained melted and kneaded material is cooled and solidified and then coarsely pulverized, finely pulverized, and classified, and the external additives, e.g., inorganic fine particles and magnetic iron oxide particles, are externally added and mixed into the resulting magnetic toner particles to obtain the magnetic toner.

The mixer used here can be exemplified by the Henschel mixer (Mitsui Mining Co., Ltd.); Supermixer (Kawata Mfg. Co., Ltd.); Ribocone (Okawara Corporation); Nauta mixer, Turbulizer, and Cyclomix (Hosokawa Micron Corporation); Spiral Pin Mixer (Pacific Machinery & Engineering Co., Ltd.); Loedige Mixer (Matsubo Corporation); and Nobilta (Hosokawa Micron Corporation).

The aforementioned kneading apparatus can be exemplified by the KRC Kneader (Kurimoto, Ltd.); Buss Ko-Kneader (Buss Corp.); TEM extruder (Toshiba Machine Co., Ltd.); TEX twin-screw kneader (The Japan Steel Works, Ltd.); PCM Kneader (Ikegai Ironworks Corporation); three-roll mills, mixing roll mills, kneaders (Inoue Manufacturing Co., Ltd.); Kneadex (Mitsui Mining Co., Ltd.); model MS pressure kneader and Kneader-Ruder (Moriyama Mfg. Co., Ltd.); and Banbury mixer (Kobe Steel, Ltd.).

The aforementioned pulverizer can be exemplified by the Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

Among the preceding, the average circularity can be controlled by adjusting the exhaust gas temperature during micropulverization using a Turbo Mill. A lower exhaust gas temperature (for example, no more than 40° C.) provides a smaller value for the average circularity while a higher exhaust gas temperature (for example, around 50° C.) provides a higher value for the average circularity.

The aforementioned classifier can be exemplified by the Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow Jet (Nittetsu Mining Co., Ltd.); Dispersion Separator (Nippon Pneumatic Mfg. Co., Ltd.); and YM Microcut (Yasukawa Shoji Co., Ltd.).

Screening devices that can be used to screen the coarse particles can be exemplified by the Ultrasonic (Koei Sangyo Co., Ltd.), Rezona Sieve and Gyro-Sifter (Tokuju Corporation), Vibrasonic System (Dalton Co., Ltd.), Soniclean (Sintokogio, Ltd.), Turbo Screener (Turbo Kogyo Co., Ltd.), Microsifter (Makino Mfg. Co., Ltd.), and circular vibrating sieves.

Figure 6:
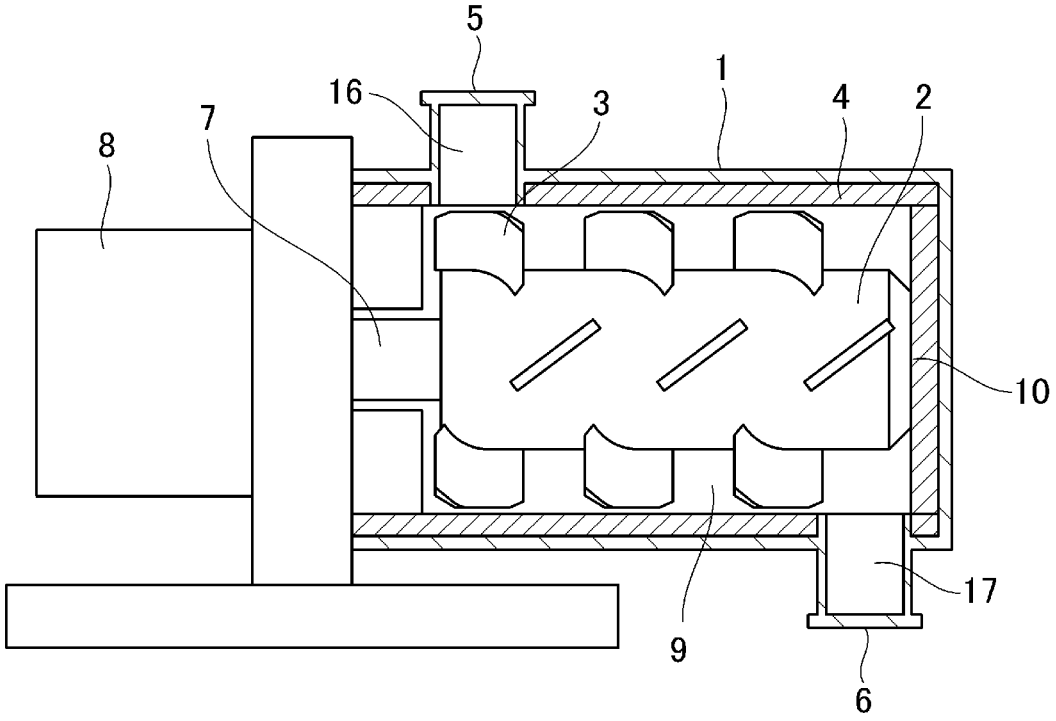
FIG. 6 is a schematic diagram that shows an example of a mixing process apparatus that can be used for the external addition and mixing of inorganic fine particles.

A known mixing process apparatus, e.g., the mixers described above, can be used for the external addition and mixing of the inorganic fine particles; however, an apparatus as shown in FIG. 6 is preferred from the standpoint of enabling facile control of the coverage ratio A, B/A, and the coefficient of variation on the coverage ratio A. Moreover, a mixing process apparatus that implements external addition and mixing of magnetic iron oxide particles is also preferred.

FIG. 6 is a schematic diagram that shows an example of a mixing process apparatus that can be used to carry out the external addition and mixing of the inorganic fine particles used by the present invention.

This mixing process apparatus readily brings about fixing of the inorganic fine particles to the magnetic toner particle surface because it has a structure that applies shear in a narrow clearance region to the magnetic toner particles and the inorganic fine particles.

Furthermore, as described below, the coverage ratio A, B/A, and coefficient of variation on the coverage ratio A are easily controlled into the ranges preferred for the present invention because circulation of the magnetic toner particles and inorganic fine particles in the axial direction of the rotating member is facilitated and because a thorough and uniform mixing is facilitated prior to the development of fixing.

Figure 7:
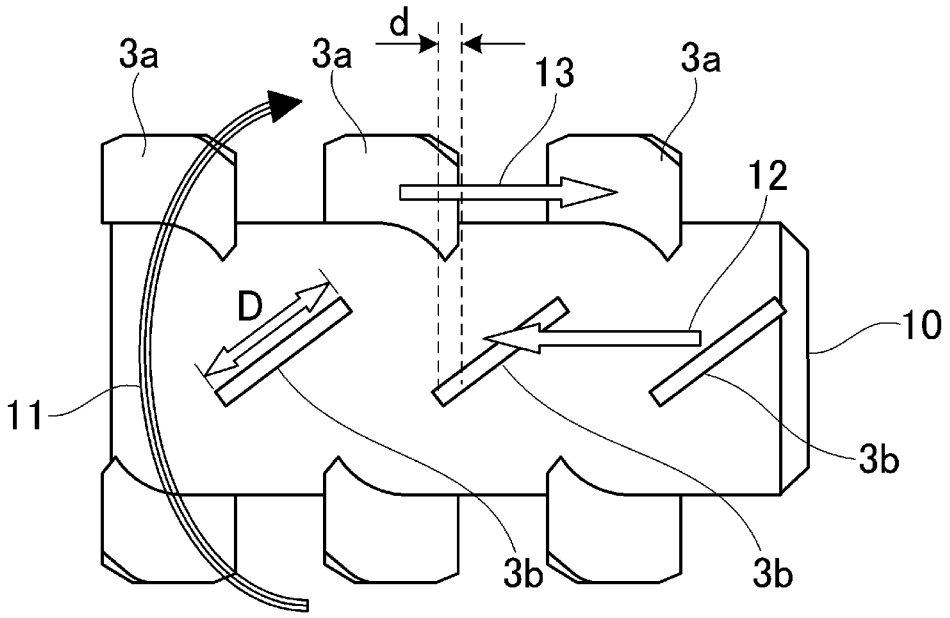
FIG. 7 is a schematic diagram that shows an example of the structure of a stirring member used in the mixing process apparatus.

On the other hand, FIG. 7 is a schematic diagram that shows an example of the structure of the stirring member used in the aforementioned mixing process apparatus.

The external addition and mixing process for the inorganic fine particles is described below using FIGS. 6 and 7.

This mixing process apparatus that carries out external addition and mixing of the inorganic fine particles has a rotating member 2, on the surface of which at least a plurality of stirring members 3 are disposed; a drive member 8, which drives the rotation of the rotating member; and a main casing 1, which is disposed to have a gap with the stirring members 3.

It is important that the gap (clearance) between the inner circumference of the main casing 1 and the stirring member 3 be maintained constant and very small in order to apply a uniform shear to the magnetic toner particles and facilitate the fixing of the inorganic fine particles to the magnetic toner particle surface.

The diameter of the inner circumference of the main casing 1 in this apparatus is not more than twice the diameter of the outer circumference of the rotating member 2. In FIG. 6, an example is shown in which the diameter of the inner circumference of the main casing 1 is 1.7-times the diameter of the outer circumference of the rotating member 2 (the trunk diameter provided by subtracting the stirring member 3 from the rotating member 2). When the diameter of the inner circumference of the main casing 1 is not more than twice the diameter of the outer circumference of the rotating member 2, impact force is satisfactorily applied to the magnetic toner particles since the processing space in which forces act on the magnetic toner particles is suitably limited.

In addition, it is important that the aforementioned clearance be adjusted in conformity to the size of the main casing. Viewed from the standpoint of the application of adequate shear to the magnetic toner particles, it is important that the clearance be made from about at least 1% to not more than 5% of the diameter of the inner circumference of the main casing 1. Specifically, when the diameter of the inner circumference of the main casing 1 is approximately 130 mm, the clearance is preferably made approximately from at least 2 mm to not more than 5 mm; when the diameter of the inner circumference of the main casing 1 is about 800 mm, the clearance is preferably made approximately from at least 10 mm to not more than 30 mm.

In the process of the external addition and mixing of the inorganic fine particles in the present invention, mixing and external addition of the inorganic fine particles to the magnetic toner particle surface are performed using the mixing process apparatus by rotating the rotating member 2 by the drive member 8 and stirring and mixing the magnetic toner particles and inorganic fine particles that have been introduced into the mixing process apparatus.

As shown in FIG. 7, at least a portion of the plurality of stirring members 3 is formed as a forward transport stirring member 3*a* that, accompanying the rotation of the rotating member 2, transports the magnetic toner particles and inorganic fine particles in one direction along the axial direction of the rotating member. In addition, at least a portion of the plurality of stirring members 3 is formed as a back transport stirring member 3*b* that, accompanying the rotation of the rotating member 2, returns the magnetic toner particles and inorganic fine particles in the other direction along the axial direction of the rotating member.

Here, when the raw material inlet port 5 and the product discharge port 6 are disposed at the two ends of the main casing 1, as in FIG. 6, the direction toward the product discharge port 6 from the raw material inlet port 5 (the direction to the right in FIG. 6) is the "forward direction".

That is, as shown in FIG. 7, the face of the forward transport stirring member 3*a* is tilted so as to transport the magnetic toner particles in the forward direction (13). On the other hand, the face of the back transport stirring member 3*b* is tilted so as to transport the magnetic toner particles and the inorganic fine particles in the back direction (12).

By doing this, the external addition of the inorganic fine particles to the surface of the magnetic toner particles and mixing are carried out while repeatedly performing transport in the "forward direction" (13) and transport in the "back direction" (12).

In addition, with regard to the stirring members 3*a*, 3*b*, a plurality of members disposed at intervals in the circumferential direction of the rotating member 2 form a set. In the example shown in FIG. 7, two members at an interval of 180° with each other form a set of the stirring members 3*a*, 3*b* on the rotating member 2, but a larger number of members may form a set, such as three at an interval of 120° or four at an interval of 90°.

In the example shown in FIG. 7, a total of twelve stirring members 3*a*, 3*b* are formed at an equal interval.

Furthermore, D in FIG. 7 indicates the width of a stirring member and d indicates the distance that represents the overlapping portion of a stirring member. In FIG. 7, D is preferably a width that is approximately from at least 20% to not more than 30% of the length of the rotating member 2, when considered from the standpoint of bringing about an efficient transport of the magnetic toner particles and inorganic fine particles in the forward direction and back direction. FIG. 7 shows an example in which D is 23%. Furthermore, with regard to the stirring members 3*a* and 3*b*, when an extension line is drawn in the perpendicular direction from the location of the end of the stirring member 3*a*, a certain overlapping portion d of the stirring member with the stirring member 3*b* is preferably present. This serves to efficiently apply shear to the magnetic toner particles. This d is preferably from at least 10% to not more than 30% of D from the standpoint of the application of shear.

In addition to the shape shown in FIG. 7, the blade shape may be—insofar as the magnetic toner particles can be transported in the forward direction and back direction and the clearance is retained—a shape having a curved surface or a paddle structure in which a distal blade element is connected to the rotating member 2 by a rod-shaped arm.

The present invention will be described in additional detail herebelow with reference to the schematic diagrams of the apparatus shown in FIGS. 6 and 7.

The apparatus shown in FIG. 6 has a rotating member 2, which has at least a plurality of stirring members 3 disposed on its surface; a drive member 8 that drives the rotation of the rotating member 2; a main casing 1, which is disposed forming a gap with the stirring members 3; and a jacket 4, in which a heat transfer medium can flow and which resides on the inside of the main casing 1 and at the end surface 10 of the rotating member.

In addition, the apparatus shown in FIG. 6 has a raw material inlet port 5, which is formed on the upper side of the main casing 1 for the purpose of introducing the magnetic toner particles and the inorganic fine particles, and a product discharge port 6, which is formed on the lower side of the main casing 1 for the purpose of discharging, from the main casing to the outside, the magnetic toner that has been subjected to the external addition and mixing process.

The apparatus shown in FIG. 6 also has a raw material inlet port inner piece 16 inserted in the raw material inlet port 5 and a product discharge port inner piece 17 inserted in the product discharge port 6.

In the present invention, the raw material inlet port inner piece 16 is first removed from the raw material inlet port 5 and the magnetic toner particles are introduced into the processing space 9 from the raw material inlet port 5. Then, the inorganic fine particles are introduced into the processing space 9 from the raw material inlet port 5 and the raw material inlet port inner piece 16 is inserted. The rotating member 2 is subsequently rotated by the drive member 8 (11 represents the direction of rotation), and the thereby introduced material to be processed is subjected to the external addition and mixing process while being stirred and mixed by the plurality of stirring members 3 disposed on the surface of the rotating member 2.

The sequence of introduction may also be introduction of the inorganic fine particles through the raw material inlet port 5 first and then introduction of the magnetic toner particles through the raw material inlet port 5. In addition, the magnetic toner particles and the inorganic fine particles may be mixed in advance using a mixer such as a Henschel mixer and the mixture may thereafter be introduced through the raw material inlet port 5 of the apparatus shown in FIG. 6.

More specifically, with regard to the conditions for the external addition and mixing process, controlling the power of the drive member 8 to from at least 0.2 W/g to not more than 2.0 W/g is preferred in terms of obtaining the coverage ratio A, B/A, and coefficient of variation on the coverage ratio A specified by the present invention. Controlling the power of the drive member 8 to from at least 0.6 W/g to not more than 1.6 W/g is more preferred.

When the power is lower than 0.2 W/g, it is difficult to obtain a high coverage ratio A, and B/A tends to be too low. On the other hand, B/A tends to be too high when 2.0 W/g is exceeded.

The processing time is not particularly limited, but is preferably from at least 3 minutes to not more than 10 minutes. When the processing time is shorter than 3 minutes, B/A tends to be low and a large coefficient of variation on the coverage ratio A is prone to occur. On the other hand, when the processing time exceeds 10 minutes, B/A conversely tends to be high and the temperature within the apparatus is prone to rise.

The rotation rate of the stirring members during external addition and mixing is not particularly limited; however, when, for the apparatus shown in FIG. 6, the volume of the processing space 9 in the apparatus is $2.0\times10^{-3}$ $m^3$, the rpm of the stirring members—when the shape of the stirring members 3 is as shown in FIG. 7—is preferably from at least 1000 rpm to not more than 3000 rpm. The coverage ratio A, B/A, and coefficient of variation on the coverage ratio A as specified for the present invention are readily obtained at from at least 1000 rpm to not more than 3000 rpm.

A particularly preferred processing method for the present invention has a pre-mixing step prior to the external addition and mixing process step. Inserting a pre-mixing step achieves a very uniform dispersion of the inorganic fine particles on the magnetic toner particle surface, and as a result a high coverage ratio A is readily obtained and the coefficient of variation on the coverage ratio A is readily reduced.

More specifically, the pre-mixing processing conditions are preferably a power of the drive member 8 of from at least 0.06 W/g to not more than 0.20 W/g and a processing time of from at least 0.5 minutes to not more than 1.5 minutes. It is difficult to obtain a satisfactorily uniform mixing in the pre-mixing when the loaded power is below 0.06 W/g or the processing time is shorter than 0.5 minutes for the pre-mixing processing conditions. When, on the other hand, the loaded power is higher than 0.20 W/g or the processing time is longer than 1.5 minutes for the pre-mixing processing conditions, the inorganic fine particles may become fixed to the magnetic toner particle surface before a satisfactorily uniform mixing has been achieved.

After the external addition and mixing process has been finished, the product discharge port inner piece 17 in the product discharge port 6 is removed and the rotating member 2 is rotated by the drive member 8 to discharge the magnetic toner from the product discharge port 6. As necessary, coarse particles and so forth may be separated from the obtained magnetic toner using a screen or sieve, for example, a circular vibrating screen, to obtain the magnetic toner.

Figure 8:
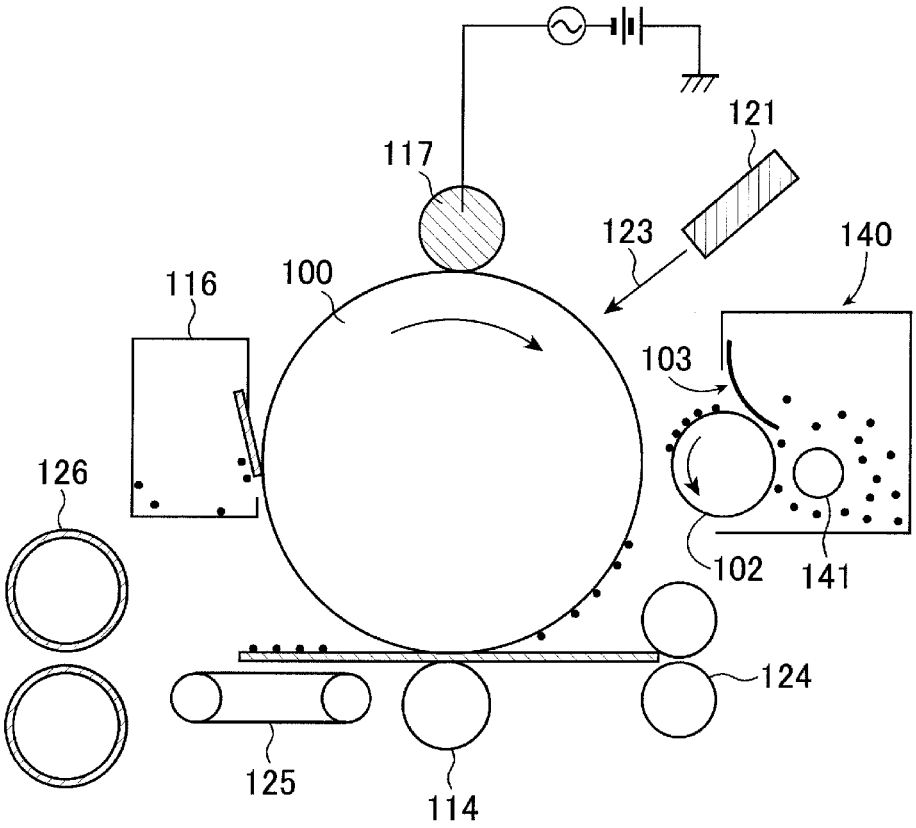
FIG. 8 is a diagram that shows an example of an image-forming apparatus.

An example of an image-forming apparatus that can advantageously use the magnetic toner of the present invention is specifically described below with reference to FIG. 8. In FIG. 8, 100 is an electrostatic latent image-bearing member (also referred to below as a photosensitive member), and the following, inter alia, are disposed on its circumference: a charging member (also referred to below as charging roller) 117, a developing device 140 having a toner-carrying member 102, a transfer member (also referred to below as transfer charging roller) 114, a cleaner 116, a fixing unit 126, and a register roller 124. The electrostatic latent image-bearing member 100 is charged by the charging member 117. Photoexposure is performed by irradiating the electrostatic latent image-bearing member 100 with laser light from a laser generator 121 to form an electrostatic latent image corresponding to the intended image. The electrostatic latent image on the electrostatic latent image-bearing member 100 is developed by the developing device 140 with a monocomponent toner to provide a toner image, and the toner image is transferred onto a transfer material by the transfer member 114, which contacts the electrostatic latent image-bearing member with the transfer material interposed therebetween. The toner image-bearing transfer material is conveyed to the fixing unit 126 and fixing on the transfer material is carried out. In addition, the toner remaining to some extent on the electrostatic latent image-bearing member is scraped off by the cleaning blade and is stored in the cleaner 116.

The methods for measuring the various properties referenced by the present invention are described below.

<Calculation of the Coverage Ratio A>

The coverage ratio A is calculated in the present invention by analyzing, using Image-Pro Plus ver. 5.0 image analysis software (Nippon Roper Kabushiki Kaisha), the image of the magnetic toner surface taken with Hitachi's S-4800 ultrahigh resolution field emission scanning electron microscope (Hitachi High-Technologies Corporation). The conditions for image acquisition with the S-4800 are as follows.

(1) Specimen Preparation

An electroconductive paste is spread in a thin layer on the specimen stub (15 mm×6 mm aluminum specimen stub) and the magnetic toner is sprayed onto this. Additional blowing with air is performed to remove excess magnetic toner from the specimen stub and carry out thorough drying. The specimen stub is set in the specimen holder and the specimen stub height is adjusted to 36 mm with the specimen height gauge.

(2) Setting the Conditions for Observation with the 5-4800

The coverage ratio A is calculated using the image obtained by backscattered electron imaging with the 5-4800. The coverage ratio A can be measured with excellent accuracy using the backscattered electron image because the inorganic fine particles are charged up less than is the case with the secondary electron image.

Introduce liquid nitrogen to the brim of the anti-contamination trap located in the S-4800 housing and allow to stand for 30 minutes. Start the "PC-SEM" of the S-4800 and perform flashing (the FE tip, which is the electron source, is cleaned). Click the acceleration voltage display area in the control panel on the screen and press the [flashing] button to open the flashing execution dialog. Confirm a flashing intensity of 2 and execute. Confirm that the emission current due to flashing is 20 to 40 μA. Insert the specimen holder in the specimen chamber of the S-4800 housing. Press [home] on the control panel to transfer the specimen holder to the observation position.

Click the acceleration voltage display area to open the HV setting dialog and set the acceleration voltage to [0.8 kV] and the emission current to [20 μA]. In the [base] tab of the operation panel, set signal selection to [SE]; select [upper(U)] and [+BSE] for the SE detector; and select [L.A. 100] in the selection box to the right of [+BSE] to go into the observation mode using the backscattered electron image. Similarly, in the [base] tab of the operation panel, set the probe current of the electron optical system condition block to [Normal]; set the focus mode to [UHR]; and set WD to [3.0 mm]. Push the [ON] button in the acceleration voltage display area of the control panel and apply the acceleration voltage.

(3) Calculation of the Number-Average Particle Diameter (D1) of the Magnetic Toner Set the magnification to 5000× (5 k) by dragging within the magnification indicator area of the control panel. Turn the [COARSE] focus knob on the operation panel and perform adjustment of the aperture alignment where some degree of focus has been obtained. Click [Align] in the control panel and display the alignment dialog and select [beam]. Migrate the displayed beam to the center of the concentric circles by turning the STIGMA/ALIGNMENT knobs (X, Y) on the operation panel. Then select [aperture] and turn the STIGMA/ALIGNMENT knobs (X, Y) one at a time and adjust so as to stop the motion of the image or minimize the motion. Close the aperture dialog and focus with the autofocus. Focus by repeating this operation an additional two times.

After this, determine the number-average particle diameter (D1) by measuring the particle diameter at 300 magnetic toner particles. The particle diameter of the individual particle is taken to be the maximum diameter when the magnetic toner particle is observed.

(4) Focus Adjustment

For particles with a number-average particle diameter (D1) obtained in (3) of ±0.1 μm, with the center of the maximum diameter adjusted to the center of the measurement screen, drag within the magnification indication area of the control panel to set the magnification to 10000× (10 k). Turn the [COARSE] focus knob on the operation panel and perform adjustment of the aperture alignment where some degree of focus has been obtained. Click [Align] in the control panel and display the alignment dialog and select [beam]. Migrate the displayed beam to the center of the concentric circles by turning the STIGMA/ALIGNMENT knobs (X, Y) on the operation panel. Then select [aperture] and turn the STIGMA/ALIGNMENT knobs (X, Y) one at a time and adjust so as to stop the motion of the image or minimize the motion. Close the aperture dialog and focus using autofocus. Then set the magnification to 50000× (50 k); carry out focus adjustment as above using the focus knob and the STIGMA/ALIGNMENT knob; and re-focus using autofocus. Focus by repeating this operation. Here, because the accuracy of the coverage ratio measurement is prone to decline when the observation plane has a large tilt angle, carry out the analysis by making a selection with the least tilt in the surface by making a selection during focus adjustment in which the entire observation plane is simultaneously in focus.

(5) Image Capture

Carry out brightness adjustment using the ABC mode and take a photograph with a size of 640×480 pixels and store. Carry out the analysis described below using this image file. Take one photograph for each magnetic toner particle and obtain images for at least 30 magnetic toner particles.

(6) Image Analysis

The coverage ratio A is calculated in the present invention using the analysis software indicated below by subjecting the image obtained by the above-described procedure to binarization processing. When this is done, the above-described single image is divided into 12 squares and each is analyzed. However, when an inorganic fine particle with a particle diameter greater than or equal to 50 nm is present within a partition, calculation of the coverage ratio A is not performed for this partition.

The analysis conditions with the Image-Pro Plus ver. 5.0 image analysis software are as follows.

Software: Image-ProPlus5.1J

From "measurement" in the tool-bar, select "count/size" and then "option" and set the binarization conditions. Select 8 links in the object extraction option and set smoothing to 0. In addition, preliminary screening, fill vacancies, and envelope are not selected and the "exclusion of boundary line" is set to "none". Select "measurement items" from "measurement" in the tool-bar and enter 2 to $10^7$ for the area screening range.

The coverage ratio is calculated by marking out a square zone. Here, the area (C) of the zone is made 24000 to 26000 pixels. Automatic binarization is performed by "processing"-binarization and the total area (D) of the silica-free zone is calculated.

The coverage ratio a is calculated using the following formula from the area C of the square zone and the total area D of the silica-free zone.

$$\text{coverage ratio } a\ (\%)=100-(D/C\times 100)$$

As noted above, calculation of the coverage ratio a is carried out for at least 30 magnetic toner particles. The average value of all the obtained data is taken to be the coverage ratio A of the present invention.

<The Coefficient of Variation on the Coverage Ratio A>

The coefficient of variation on the coverage ratio A is determined in the present invention as follows. The coefficient of variation on the coverage ratio A is obtained using the following formula letting σ(A) be the standard deviation on all the coverage ratio data used in the calculation of the coverage ratio A described above.

$$\text{coefficient of variation } (\%)=\{\sigma(A)/A\}\times 100$$

<Calculation of the Coverage Ratio B>

The coverage ratio B is calculated by first removing the unfixed inorganic fine particles on the magnetic toner surface and thereafter carrying out the same procedure as followed for the calculation of the coverage ratio A.

(1) Removal of the Unfixed Inorganic Fine Particles

The unfixed inorganic fine particles are removed as described below. The present inventors investigated and then set these removal conditions in order to thoroughly remove the inorganic fine particles other than those embedded in the toner surface.

Figure 9:
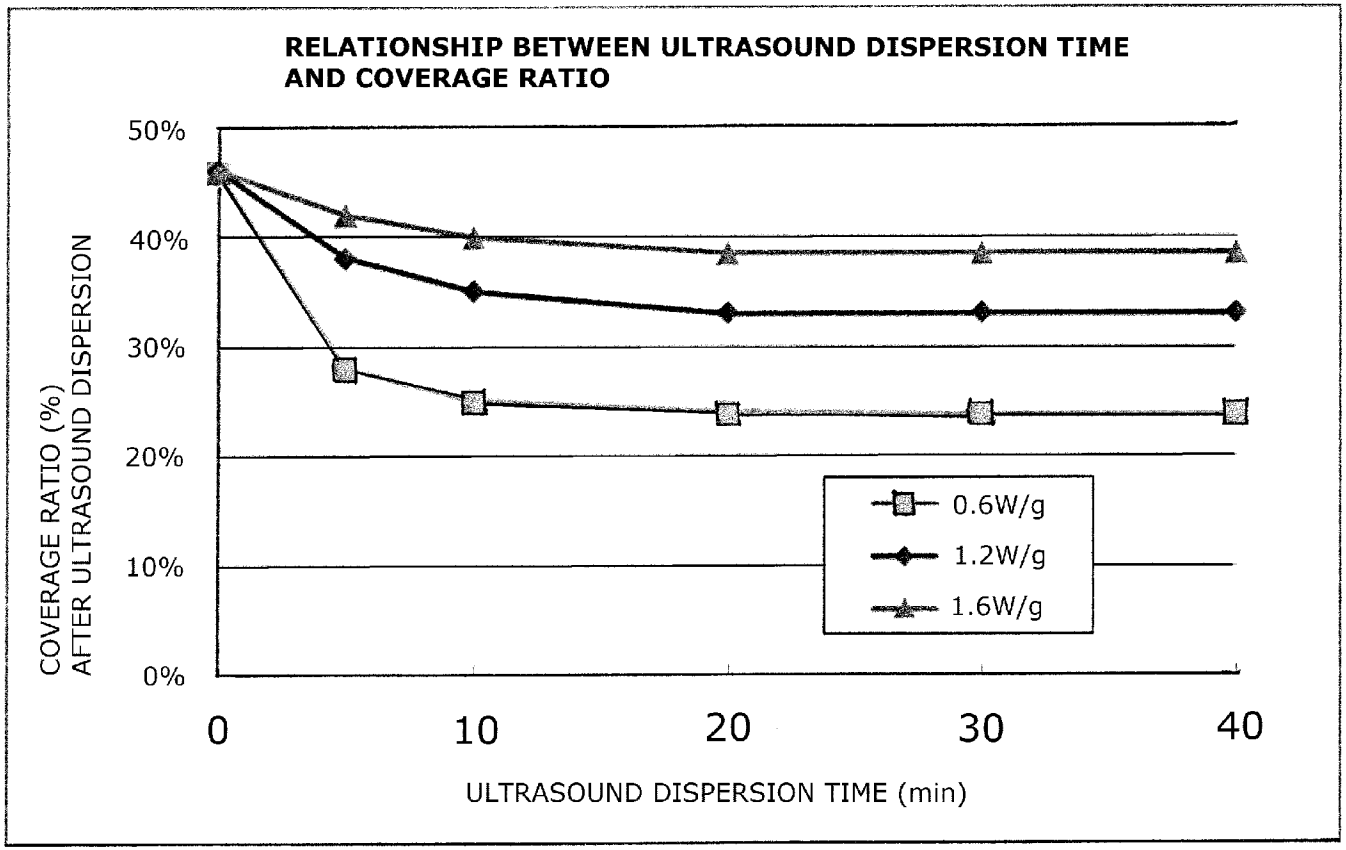
FIG. 9 is a diagram that shows an example of the relationship between the ultrasound dispersion time and the coverage ratio.

As an example, FIG. 9 shows the relationship between the ultrasound dispersion time and the coverage ratio calculated post-ultrasound dispersion, for magnetic toners in which the coverage ratio A was brought to 46% using the apparatus shown in FIG. 6 at three different external addition intensities. FIG. 9 was constructed by calculating, using the same procedure as for the calculation of coverage ratio A as described above, the coverage ratio of a magnetic toner provided by removing the inorganic fine particles by ultrasound dispersion by the method described below and then drying.

FIG. 9 demonstrates that the coverage ratio declines in association with removal of the inorganic fine particles by ultrasound dispersion and that, for all of the external addition intensities, the coverage ratio is brought to an approximately constant value by ultrasound dispersion for 20 minutes. Based on this, ultrasound dispersion for 30 minutes was regarded as providing a thorough removal of the inorganic fine particles other than the inorganic fine particles embedded in the toner surface and the thereby obtained coverage ratio was defined as coverage ratio B.

Considered in greater detail, 16.0 g of water and 4.0 g of Contaminon N (a neutral detergent from Wako Pure Chemical Industries, Ltd., product No. 037-10361) are introduced into a 30 mL glass vial and are thoroughly mixed. 1.50 g of the magnetic toner is introduced into the resulting solution and the magnetic toner is completely submerged by applying a magnet at the bottom. After this, the magnet is moved around in order to condition the magnetic toner to the solution and remove air bubbles.

The tip of a UH-50 ultrasound oscillator (from SMT Co., Ltd., the tip used is a titanium alloy tip with a tip diameter φ of 6 mm) is inserted so it is in the center of the vial and resides at a height of 5 mm from the bottom of the vial, and the inorganic fine particles are removed by ultrasound dispersion. After the application of ultrasound for 30 minutes, the entire amount of the magnetic toner is removed and dried. During this time, as little heat as possible is applied while carrying out vacuum drying at not more than 30° C.

(2) Calculation of the Coverage Ratio B

After the drying as described above, the coverage ratio of the magnetic toner is calculated as for the coverage ratio A described above, to obtain the coverage ratio B.

<Method of Measuring the Number-Average Particle Diameter of the Primary Particles of the Inorganic Fine Particles>

The number-average particle diameter of the primary particles of the inorganic fine particles is calculated from the inorganic fine particle image on the magnetic toner surface taken with Hitachi's S-4800 ultrahigh resolution field emission scanning electron microscope (Hitachi High-Technologies Corporation). The conditions for image acquisition with the S-4800 are as follows.

The same steps (1) to (3) as described above in "Calculation of the coverage ratio A" are carried out; focusing is performed by carrying out focus adjustment at a 50000× magnification of the magnetic toner surface as in (4); and the brightness is then adjusted using the ABC mode. This is followed by bringing the magnification to 100000×; performing focus adjustment using the focus knob and STIGMA/ALIGNMENT knobs as in (4); and focusing autofocus. The focus adjustment process is repeated to achieve focus at 100000×.

After this, the particle diameter is measured on at least 300 inorganic fine particles on the magnetic toner surface and the number-average particle diameter (D1) is determined. Here, because the inorganic fine particles are also present as aggregates, the maximum diameter is determined on what can be identified as the primary particle, and the primary particle number-average particle diameter (D1) is obtained by taking the arithmetic average of the obtained maximum diameters.

<Quantitation Methods for the Inorganic Fine Particles>

(1) Determination of the Content of Silica Fine Particles in the Magnetic Toner (Standard Addition Method)

3 g of the magnetic toner is introduced into an aluminum ring having a diameter of 30 mm and a pellet is prepared using a pressure of 10 tons. The silicon (Si) intensity is determined (Si intensity-1) by wavelength-dispersive x-ray fluorescence analysis (XRF). The measurement conditions are preferably optimized for the XRF instrument used and all of the intensity measurements in a series are performed using the same conditions. Silica fine particles with a primary particle number-average particle diameter of 12 nm are added to the magnetic toner at 1.0 mass % with reference to the magnetic toner and mixing is carried out with a coffee mill.

For the silica fine particles admixed at this time, silica fine particles with a primary particle number-average particle diameter of from at least 5 nm to not more than 50 nm can be used without affecting this determination.

After mixing, pellet fabrication is carried out as described above and the Si intensity (Si intensity-2) is determined also as described above. Using the same procedure, the Si intensity (Si intensity-3, Si intensity-4) is also determined for samples prepared by adding and mixing the silica fine particles at 2.0 mass % and 3.0 mass % of the silica fine particles with reference to the magnetic toner. The silica content (mass %) in the magnetic toner based on the standard addition method is calculated using Si intensities-1 to -4.

The titania content (mass %) in the magnetic toner and the alumina content (mass %) in the magnetic toner are determined using the standard addition method and the same procedure as described above for the determination of the silica content. That is, for the titania content (mass %), titania fine particles with a primary particle number-average particle diameter of from at least 5 nm to not more than 50 nm are added and mixed and the determination can be made by determining the titanium (Ti) intensity. For the alumina content (mass %), alumina fine particles with a primary particle number-average particle diameter of from at least 5 nm to not more than 50 nm are added and mixed and the determination can be made by determining the aluminum (Al) intensity.

(2) Separation of the Inorganic Fine Particles from the Magnetic Toner 5 g of the magnetic toner is weighed using a precision balance into a lidded 200-mL plastic cup; 100 mL methanol is added; and dispersion is carried out for 5 minutes using an ultrasound disperser. The magnetic toner is held using a neodymium magnet and the supernatant is discarded. The process of dispersing with methanol and discarding the supernatant is carried out three times, followed by the addition of 100 mL of 10% NaOH and several drops of "Contaminon N" (a 10 mass % aqueous solution of a neutral pH 7 detergent for cleaning precision measurement instrumentation and comprising a nonionic surfactant, an anionic surfactant, and an organic builder, from Wako Pure Chemical Industries, Ltd.), light mixing, and then standing at quiescence for 24 hours. This is followed by re-separation using a neodymium magnet. Repeated washing with distilled water is carried out at this point until NaOH does not remain. The recovered particles are thoroughly dried using a vacuum drier to obtain particles A. The externally added silica fine particles are dissolved and removed by this process. Titania fine particles and alumina fine particles can remain present in particles A since they are sparingly soluble in 10% NaOH.

(3) Measurement of the Si Intensity in the Particles A 3 g of the particles A are introduced into an aluminum ring with a diameter of 30 mm; a pellet is fabricated using a pressure of 10 tons; and the Si intensity (Si intensity-5) is determined by wavelength-dispersive XRF. The silica content (mass %) in particles A is calculated using the Si intensity-5 and the Si intensities-1 to –4 used in the determination of the silica content in the magnetic toner.

(4) Separation of the Magnetic Body from the Magnetic Toner 100 mL of tetrahydrofuran is added to 5 g of the particles A with thorough mixing followed by ultrasound dispersion for 10 minutes. The magnetic body is held with a magnet and the supernatant is discarded. This process is performed 5 times to obtain particles B. This process can almost completely remove the organic component, e.g., resins, outside the magnetic body. However, because a tetrahydrofuran-insoluble matter in the resin can remain, the particles B provided by this process are preferably heated to 800° C. in order to burn off the residual organic component, and the particles C obtained after heating are approximately the magnetic body that was present in the magnetic toner.

Measurement of the mass of the particles C yields the magnetic body content W (mass %) in the magnetic toner. In order to correct for the increment due to oxidation of the magnetic body, the mass of particles C is multiplied by 0.9666 ($Fe_2O_3 \rightarrow Fe_3O_4$).

(5) Measurement of the Ti Intensity and Al Intensity in the Separated Magnetic Body Ti and Al may be present as impurities or additives in the magnetic body. The amount of Ti and Al attributable to the magnetic body can be detected by FP quantitation in wavelength-dispersive XRF. The detected amounts of Ti and Al are converted to titania and alumina and the titania content and alumina content in the magnetic body are then calculated.

The amount of externally added silica fine particles, the amount of externally added titania fine particles, and the amount of externally added alumina fine particles are calculated by substituting the quantitative values obtained by the preceding procedures into the following formulas.

amount of externally added silica fine particles (mass %)=silica content (mass %) in the magnetic toner−silica content (mass %) in particle *A* amount of externally added titania fine particles (mass %)=titania content (mass %) in the magnetic toner−{titania content (mass %) in the magnetic body×magnetic body content *W*/100} amount of externally added alumina fine particles (mass %)=alumina content (mass %) in the magnetic toner−{alumina content (mass %) in the magnetic body×magnetic body content *W*/100}

(6) Calculation of the Proportion of Silica Fine Particles in the Metal Oxide Fine Particles Selected from the Group Consisting of Silica Fine Particles, Titania Fine Particles, and Alumina Fine Particles, for the Inorganic Fine Particles Fixed to the Magnetic Toner Particle Surface After carrying out the procedure, "Removing the unfixed inorganic fine particles", in the method for calculating the coverage ratio B and thereafter drying the toner, the proportion of the silica fine particles in the metal oxide fine particles can be calculated by carrying out the same procedures as in the method of (1) to (5) described above.

<Method for Measuring the Weight Average Particle Diameter (D4) and the Number Average Particle Diameter (D1) of the Magnetic Toner>

The weight average particle diameter (D4) and the number average particle diameter (D1) of the magnetic toner is calculated as follows. The measurement instrument used is a "Coulter Counter Multisizer 3" (registered trademark, from Beckman Coulter, Inc.), a precision particle size distribution measurement instrument operating on the pore electrical resistance principle and equipped with a 100 μm aperture tube. The measurement conditions are set and the measurement data are analyzed using the accompanying dedicated software, i.e., "Beckman Coulter Multisizer 3 Version 3.51" (from Beckman Coulter, Inc.). The measurements are carried at 25000 channels for the number of effective measurement channels.

The aqueous electrolyte solution used for the measurements is prepared by dissolving special-grade sodium chloride in ion-exchanged water to provide a concentration of about 1 mass % and, for example, "ISOTON II" (from Beckman Coulter, Inc.) can be used.

The dedicated software is configured as follows prior to measurement and analysis.

In the "modify the standard operating method (SOM)" screen in the dedicated software, the total count number in the control mode is set to 50000 particles; the number of measurements is set to 1 time; and the Kd value is set to the value obtained using "standard particle 10.0 μm" (from Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube have previously been removed by the "aperture flush" function of the dedicated software.

(2) Approximately 30 mL of the above-described aqueous electrolyte solution is introduced into a 100-mL flatbottom glass beaker. To this is added as dispersant about 0.3 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of ion-exchanged water is introduced into the water tank of this ultrasound disperser and approximately 2 mL of Contaminon N is added to the water tank.

(4) The beaker described in (2) is set into the beaker holder opening on the ultrasound disperser and the ultrasound disperser is started. The height of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of toner is added to the aqueous electrolyte solution in small aliquots and dispersion is carried out. The ultrasound dispersion treatment is continued for an additional 60 seconds. The water temperature in the water bath is controlled as appropriate during ultrasound dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of about 5%. Measurement is then performed until the number of measured particles reaches 50000.

(7) The measurement data is analyzed by the previously cited software provided with the instrument and the weight average particle diameter (D4) and the number average particle diameter (D1) are calculated. When set to graph/volume % with the dedicated software, the "average diameter" on the "analysis/volumetric statistical value (arithmetic average)" screen is the weight average particle diameter (D4), and when set to graph/number % with the dedicated software, the "average diameter" on the "analysis/numerical statistical value (arithmetic average)" screen is the number average particle diameter (D1).

<Method of Measuring the Average Circularity of the Magnetic Toner>

The average circularity of the magnetic toner is measured with the "FPIA-3000" (Sysmex Corporation), a flow-type particle image analyzer, using the measurement and analysis conditions from the calibration process.

The specific measurement method is as follows. First, approximately 20 mL of ion-exchanged water from which the solid impurities and so forth have previously been removed is placed in a glass container. To this is added as dispersant about 0.2 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.). Approximately 0.02 g of the measurement sample is also added and a dispersion treatment is carried out for 2 minutes using an ultrasound disperser to provide a dispersion for submission to measurement. Cooling is carried out as appropriate during this treatment so as to provide a dispersion temperature of at least 10° C. and no more than 40° C. The ultrasound disperser used here is a benchtop ultrasonic cleaner/disperser that has an oscillation frequency of 50 kHz and an electrical output of 150 W (for example, a "VS-150" from Velvo-Clear Co., Ltd.); a prescribed amount of ion-exchanged water is introduced into the water tank and approximately 2 mL of the aforementioned Contaminon N is also added to the water tank.

The previously cited flow-type particle image analyzer (fitted with a standard objective lens (10×)) is used for the measurement, and Particle Sheath "PSE-900A" (Sysmex Corporation) is used for the sheath solution. The dispersion prepared according to the procedure described above is introduced into the flow-type particle image analyzer and 3000 of the magnetic toner are measured according to total count mode in HPF measurement mode. The average circularity of the magnetic toner is determined with the binarization threshold value during particle analysis set at 85% and the analyzed particle diameter limited to a circle-equivalent diameter of from at least 1.985 μm to less than 39.69 μm.

For this measurement, automatic focal point adjustment is performed prior to the start of the measurement using reference latex particles (for example, a dilution with ion-exchanged water of "RESEARCH AND TEST PARTICLES Latex Microsphere Suspensions 5200A" from Duke Scientific). After this, focal point adjustment is preferably performed every two hours after the start of measurement.

In the present invention, the flow-type particle image analyzer used had been calibrated by the Sysmex Corporation and had been issued a calibration certificate by the Sysmex Corporation. The measurements are carried out under the same measurement and analysis conditions as when the calibration certificate was received, with the exception that the analyzed particle diameter is limited to a circle-equivalent diameter of from at least 1.985 μm to less than 39.69 μm.

The "FPIA-3000" flow-type particle image analyzer (Sysmex Corporation) uses a measurement principle based on taking a still image of the flowing particles and performing image analysis. The sample added to the sample chamber is delivered by a sample suction syringe into a flat sheath flow cell. The sample delivered into the flat sheath flow cell is sandwiched by the sheath liquid to form a flat flow. The sample passing through the flat sheath flow cell is exposed to stroboscopic light at an interval of 1/60 seconds, thus enabling a still image of the flowing particles to be photographed. Moreover, since flat flow is occurring, the photograph is taken under in-focus conditions. The particle image is photographed with a CCD camera; the photographed image is subjected to image processing at an image processing resolution of 512×512 pixels (0.37×0.37 μm per pixel); contour definition is performed on each particle image; and, among other things, the projected area S and the periphery length L are measured on the particle image.

The circle-equivalent diameter and the circularity are then determined using this area S and periphery length L. The circle-equivalent diameter is the diameter of the circle that has the same area as the projected area of the particle image. The circularity is defined as the value provided by dividing the circumference of the circle determined from the circle-equivalent diameter by the periphery length of the particle's projected image and is calculated using the following formula.

$$\text{circularity}=2\times(\pi\times S)^{1/2}/L$$

The circularity is 1.000 when the particle image is a circle, and the value of the circularity declines as the degree of irregularity in the periphery of the particle image increases. After the circularity of each particle has been calculated, 800 are fractionated out in the circularity range of 0.200 to 1.000; the arithmetic average value of the obtained circularities is calculated; and this value is used as the average circularity.

<Method of Measuring the Amount of Magnetic Iron Oxide Particles Present on the Magnetic Toner Particle Surface>

The amount of magnetic iron oxide particles present on the magnetic toner particle surface is measured using the following method.

19.0 g water and 1.0 g Contaminon N (neutral detergent from Wako Pure Chemical Industries, Ltd., Product No. 037-10361) are introduced into a 30-mL glass vial and are thoroughly mixed. 1.00 g of the magnetic toner is introduced into the resulting solution and a magnet is brought into proximity to the bottom surface and the magnetic toner is entirely sedimented. Following this, the magnet is moved in order to eliminate the air bubbles and bring the magnetic toner into intimate contact with the solution.

The tip of a UH-50 ultrasound oscillator (from SMT Co., Ltd., the tip used is a titanium alloy tip with a tip diameter φ of 6 mm) is inserted so that it is in the center of the vial and resides at a height of 5 mm from the bottom of the vial, and the magnetic iron oxide particles are released from the magnetic toner particle surface by ultrasound dispersion.

After the application of ultrasound for 30 minutes, the entire solution is filtered using filter paper No. 5C from Advantec. The magnetic toner on the filter paper is then washed 3 times with 30 mL water and the entire filtrate, including the wash water, is retained. At this time, only the component responding to magnetic force is removed with a magnet from among the particles present in the filtrate and is dried. The obtained component is the magnetic iron oxide particles present on the magnetic toner particle surface.

30.0 g 10% hydrochloric acid is added to the dried component followed by standing for 3 days in order to completely dissolve the dried component. This hydrochloric acid solution is diluted 10× and a quartz cell filled with the dilution is placed in an "MPS2000" spectrophotometer (Shimadzu Corporation) and allowed to stand in this state for 10 minutes in order to wait for the variation in the transmittance to die down. After the 10 minutes have elapsed, the transmittance at a measurement wavelength of 338 nm is measured.

Figure 10:
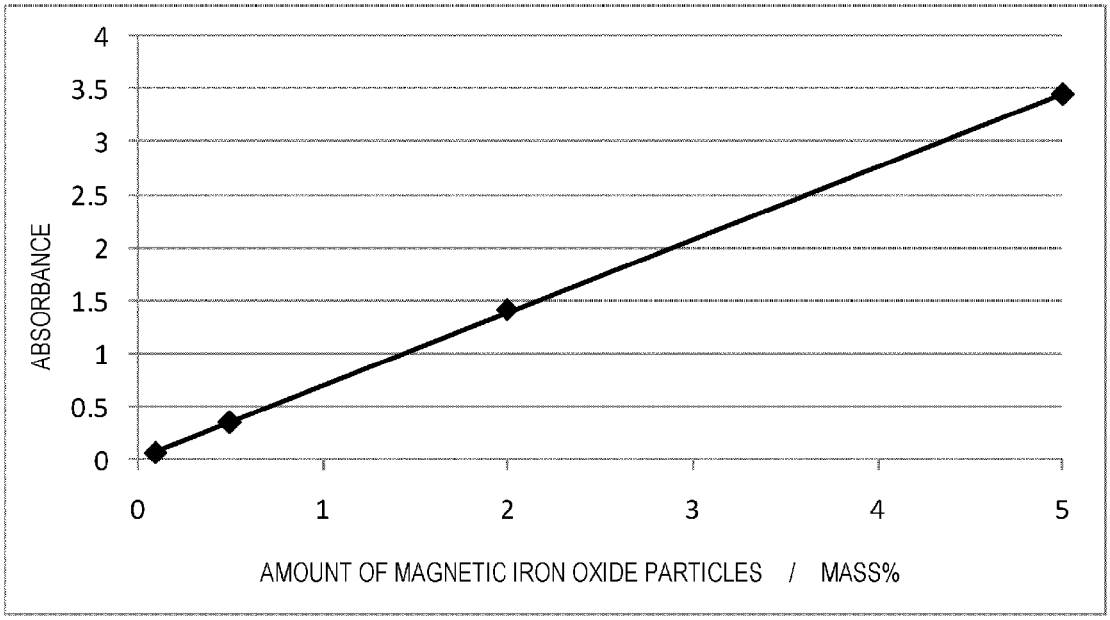
FIG. 10 is a diagram that shows the relationship between the amount of magnetic iron oxide particles and the absorbance.

The correlation shown in FIG. 10 was obtained when the present inventors carried out the experiment described above at different amounts of addition of magnetic iron oxide particles having a primary particle number-average particle diameter of 0.20 to 0.30 μm. The amount of magnetic iron oxide particles present on the magnetic toner particle surface was determined based on this data.

<Method of Measuring the Dielectric Constant ∈' of the Magnetic Toner>

Dielectric characteristics of the magnetic toner are measured by a following method.

1 g of the magnetic toner is weighed out and subjected to a load of 20 kPa for 1 minute to mold a disk-shaped measurement specimen having a diameter of 25 mm and a thickness of 1.5±0.5 mm.

This measurement specimen is mounted in an ARES (TA Instruments, Inc.) that is equipped with a dielectric constant measurement tool (electrodes) that has a diameter of 25 mm. While a load of 250 g/cm$^2$ is being applied at the measurement temperature of 40° C., the complex dielectric constant at 100 kHz and a temperature of 40° C. is measured using a 4284A Precision LCR meter (Hewlett-Packard Company) and the dielectric constant ∈' is calculated from the value measured for the complex dielectric constant.

EXAMPLES

The present invention is described in additional detail through the examples and comparative examples provided below, but the present invention is in no way restricted to these. The % and number of parts in the examples and comparative examples, unless specifically indicated otherwise, are in all instances on a mass basis.

<Production Example for Magnetic Iron Oxide Particles 1>

An aqueous solution containing ferrous hydroxide was prepared by mixing a sodium hydroxide solution, at 1.1 equivalent with reference to the iron, into an aqueous solution of ferrous sulfate. The pH of the aqueous solution was brought to 8.0 and an oxidation reaction was run at 85° C. while blowing in air to prepare a slurry containing seed crystals.

An aqueous ferrous sulfate solution was then added to provide 1.0 equivalent with reference to the amount of the starting alkali (sodium component in the sodium hydroxide) in this slurry and an oxidation reaction was run while blowing in air and maintaining the slurry at pH 12.8 to obtain a slurry containing magnetic iron oxide. This slurry was filtered, washed, dried, and ground to obtain a magnetic iron oxide particle 1 that had an octahedral structure, a primary particle number-average particle diameter (D1) of 0.20 μm, and a intensity of magnetization of 65.9 $Am^2/kg$ and residual magnetization of 7.3 $Am^2/kg$ for a magnetic field of 79.6 kA/m (1000 oersted). The properties of magnetic iron oxide particle 1 are shown in Table 1.

<Magnetic Iron Oxide Particle 2 Production Example>

An aqueous solution containing ferrous hydroxide was prepared by mixing the following in an aqueous solution of ferrous sulfate: a sodium hydroxide solution at 1.1 equivalent with reference to the iron and $SiO_2$ in an amount that provided 1.20 mass % as silicon with reference to the iron. The pH of the aqueous solution was brought to 8.0 and an oxidation reaction was run at 85° C. while blowing in air to prepare a slurry containing seed crystals.

An aqueous ferrous sulfate solution was then added to provide 1.0 equivalent with reference to the amount of the starting alkali (sodium component in the sodium hydroxide) in this slurry and an oxidation reaction was run while blowing in air and maintaining the slurry at pH 8.5 to obtain a slurry containing magnetic iron oxide. This slurry was filtered, washed, dried, and ground to obtain a magnetic iron oxide particle 2 that had a spherical structure, a primary particle number-average particle diameter (D1) of 0.22 μm, and a intensity of magnetization of 66.1 $Am^2/kg$ and residual magnetization of 5.9 $Am^2/kg$ for a magnetic field of 79.6 kA/m (1000 oersted). The properties of magnetic iron oxide particle 2 are shown in Table 1.

<Production Example for Magnetic Iron Oxide Particles 3 to 6>

Production was carried out by changing the amount of blown-in air, the reaction temperature, and the reaction time in the production of magnetic iron oxide particle 2 to obtain magnetic iron oxide particles 3, 4, 5, and 6 having primary particle number-average particle diameters (D1) of 0.14 μm, 0.30 μm, 0.07 μm, and 0.35 μm. The properties of magnetic iron oxide particles 3 to 6 are shown in Table 1.

TABLE 1

| | Shape | Primary particle number-average particle diameter [μm] | Intensity of magnetization [$Am^2/kg$] | Residual magnetization [$Am^2/kg$] | Coercive force [kA/m] |
|---|---|---|---|---|---|
| Magnetic iron oxide particle 1 | Octahedral | 0.20 | 65.9 | 7.3 | 20.0 |
| Magnetic iron oxide particle 2 | Spherical | 0.22 | 66.1 | 5.9 | 10.1 |
| Magnetic iron oxide particle 3 | Spherical | 0.14 | 64.2 | 7.9 | 11.5 |
| Magnetic iron oxide particle 4 | Spherical | 0.30 | 66.5 | 4.0 | 9.5 |
| Magnetic iron oxide particle 5 | Spherical | 0.07 | 62.0 | 10.0 | 15.3 |
| Magnetic iron oxide particle 6 | Spherical | 0.35 | 67.0 | 4.0 | 9.0 |

<Production of Magnetic Toner Particle 1>

| | |
|---|---|
| styrene/n-butyl acrylate copolymer 1 (St/nBA copolymer 1 in Table 1) (styrene and n-butyl acrylate mass ratio = 78:22, glass-transition temperature (Tg) = 58° C., peak molecular weight = 8500) | 100.0 mass parts |
| magnetic body (magnetic iron oxide particle 1) | 95.0 mass parts |
| polyethylene wax (melting point: 102° C.) | 5.0 mass parts |
| iron complex of a monoazo dye (T-77: Hodogaya Chemical Co., Ltd.) | 2.0 mass parts |

The starting materials listed above were preliminarily mixed using an FM10C Henschel mixer (Mitsui Miike Chemical Engineering Machinery Co., Ltd.) and were then kneaded with a twin-screw kneader/extruder (PCM-30, Ikegai Ironworks Corporation) set at a rotation rate of 250 rpm with the set temperature being adjusted to provide a direct temperature in the vicinity of the outlet for the kneaded material of 145° C.

The resulting melt-kneaded material was cooled; the cooled melt-kneaded material was coarsely pulverized with a cutter mill; the resulting coarsely pulverized material was finely pulverized using a Turbo Mill T-250 (Turbo Kogyo Co., Ltd.) at a feed rate of 25 kg/hr with the air temperature adjusted to provide an exhaust gas temperature of 38° C.; and classification was performed using a Coanda effect-based multifraction classifier to obtain a magnetic toner particle 1 having a weight-average particle diameter (D4) of 8.4 μm. The production conditions and physical properties with respect to the magnetic toner particle 1 are shown in Table 2.

<Production of Magnetic Toner Particle 2>

Magnetic toner particle 2 was obtained proceeding in the same manner as in the production of magnetic toner particle 1, with the exception that the apparatus used for fine pulverization was changed to a jet mill pulverizer. The production conditions and physical properties with respect to the magnetic toner particle 2 are shown in Table 2.

<Production of Magnetic Toner Particle 3>

Magnetic toner particle 3 was obtained proceeding in the same manner as in the production of magnetic toner particle 1, with the exception that the exhaust temperature of the Turbo Mill T-250 used in the production of magnetic toner particle 1 was controlled to a somewhat high 44° C. in order to adjust the average circularity of the magnetic toner particles upward. The production conditions and physical properties with respect to the magnetic toner particle 3 are shown in Table 2.

<Production of Magnetic Toner Particle 4>

Magnetic toner particle 4 was obtained proceeding as in the production of magnetic toner particle 1, with the exception that the amount of addition of magnetic iron oxide particle 1 in the production of magnetic toner particle 1 was changed to 75 mass parts. The production conditions and physical properties with respect to the magnetic toner particle 4 are shown in Table 2.

<Production of Magnetic Toner Particle 5>

Magnetic toner particle 5 was obtained proceeding as in the production of magnetic toner particle 2, with the exception that the styrene/n-butyl acrylate copolymer 1 (styrene and n-butyl acrylate mass ratio=78:22, glass-transition temperature (Tg)=58° C., peak molecular weight=8500) used in the production of magnetic toner particle 2 was changed to styrene/n-butyl acrylate copolymer 2 (styrene and n-butyl acrylate mass ratio=78:22, glass-transition temperature (Tg)=57°

C., peak molecular weight=6500) and the amount of addition of magnetic iron oxide particle 1 was changed to 75 mass parts. The production conditions and physical properties with respect to the magnetic toner particle 5 are shown in Table 2.

<Production of Magnetic Toner Particle 6>

Magnetic toner particle 6 was obtained proceeding as in the production of magnetic toner particle 3, with the exception that the amount of addition of the magnetic iron oxide particle 1 in the production of magnetic toner particle 3 was changed to 75 mass parts and the average circularity of the magnetic toner particles was adjusted upward by controlling the exhaust temperature of the Turbo Mill T-250 to an even higher 48° C. The production conditions and physical properties with respect to the magnetic toner particle 6 are shown in Table 2.

<Production of Magnetic Toner Particle 7>

Magnetic toner particle 7 was obtained proceeding as in the production of magnetic toner particle 2, with the exception that the amount of addition of magnetic iron oxide particle 1 in the production of magnetic toner particle 2 was changed to 60 mass parts. The production conditions and physical properties with respect to the magnetic toner particle 7 are shown in Table 2.

<Production of Magnetic Toner Particle 8>

100 mass parts of the magnetic toner particle 1 and 0.5 mass parts of the silica fine particle 1 used in the external addition and mixing process of Magnetic Toner 1 Production Example were introduced into an FM10C Henschel mixer (Mitsui Miike Chemical Engineering Machinery Co., Ltd.) and mixing and stirring were performed for 2 minutes at 3000 rpm.

Then, the mixed and stirred material was subjected to surface modification using a Meteorainbow (Nippon Pneumatic Mfg. Co., Ltd.), which is a device that carries out the surface modification of magnetic toner particles using a hot wind blast. The surface modification conditions were a starting material feed rate of 2 kg/hr, a hot wind flow rate of 700 L/min, and a hot wind ejection temperature of 300° C. Magnetic toner particle 8 was obtained by carrying out this hot wind treatment. The production conditions and properties for magnetic toner particle 8 are shown in Table 2.

<Production of Magnetic Toner Particle 9>

Magnetic toner particle 9 was obtained proceeding in the same manner as in the production of magnetic toner particle 8, with the exception that the amount of addition of the silica fine particle 1 added in the production of magnetic toner particle 8 was made 1.5 mass parts. The production conditions and physical properties with respect to the magnetic toner particle 9 are shown in Table 2.

<Production of Magnetic Toner Particle 10>

Magnetic toner particle 10 was obtained proceeding as in the production of magnetic toner particle 9, with the exception that the amount of addition of the silica fine particle 1 added in the production of magnetic toner particle 9 was changed to 2.0 mass parts. The production conditions and physical properties with respect to the magnetic toner particle 10 are shown in Table 2.

<Production of Magnetic Toner Particle 11>

Magnetic toner particle 11 was obtained proceeding as in the production of magnetic toner particle 2, with the exception that the amount of addition of magnetic iron oxide particle 1 in the production of magnetic toner particle 2 was changed to 80 mass parts. The production conditions and physical properties with respect to the magnetic toner particle 11 are shown in Table 2.

TABLE 2

| | Resin | Magnetic body | Amount of addition of the magnetic iron oxide particles [mass parts] | Pulverization apparatus | Exhaust temperature during pulverization | Surface modification | Average circularity | Dielectric constant (pF/m) |
|---|---|---|---|---|---|---|---|---|
| Magnetic toner particle 1 | St/nBA copolymer 1 | Magnetic iron oxide particle 1 | 95 | Turbo Mill | 38° C. | No | 0.946 | 46 |
| Magnetic toner particle 2 | St/nBA copolymer 1 | Magnetic iron oxide particle 1 | 95 | Jet Mill | — | No | 0.935 | 46 |
| Magnetic toner particle 3 | St/nBA copolymer 1 | Magnetic iron oxide particle 1 | 95 | Turbo Mill | 44° C. | No | 0.955 | 46 |
| Magnetic toner particle 4 | St/nBA copolymer 1 | Magnetic iron oxide particle 1 | 75 | Turbo Mill | 38° C. | No | 0.946 | 40 |
| Magnetic toner particle 5 | St/nBA copolymer 2 | Magnetic iron oxide particle 1 | 75 | Jet Mill | — | No | 0.932 | 40 |
| Magnetic toner particle 6 | St/nBA copolymer 1 | Magnetic iron oxide particle 1 | 75 | Turbo Mill | 48° C. | No | 0.957 | 40 |
| Magnetic toner particle 7 | St/nBA copolymer 1 | Magnetic iron oxide particle 1 | 60 | Jet Mill | — | No | 0.932 | 39 |
| Magnetic toner particle 8 | St/nBA copolymer 1 | Magnetic iron oxide particle 1 | 95 | Turbo Mill | 38° C. | Yes | 0.971 | 46 |
| Magnetic toner particle 9 | St/nBA copolymer 1 | Magnetic iron oxide particle 1 | 95 | Turbo Mill | 38° C. | Yes | 0.971 | 46 |
| Magnetic toner particle 10 | St/nBA copolymer 1 | Magnetic iron oxide particle 1 | 95 | Turbo Mill | 38° C. | Yes | 0.970 | 46 |
| Magnetic toner particle 11 | St/nBA copolymer 1 | Magnetic iron oxide particle 1 | 80 | Jet Mill | — | No | 0.931 | 43 |

<Magnetic Toner 1 Production Example>

An external addition and mixing process was carried out using the apparatus shown in FIG. 6 on the magnetic toner particle 1.

In this example, the diameter of the inner circumference of the main casing 1 of the apparatus shown in FIG. 6 was 130 mm; the apparatus used had a volume for the processing space 9 of $2.0\times10^{-3}$ $m^3$; the rated power for the drive member 8 was 5.5 kW; and the stirring member 3 had the shape given in FIG. 7. The overlap width d in FIG. 7 between the stirring member 3*a* and the stirring member 3*b* was 0.25D with respect to the maximum width D of the stirring member 3, and the clearance between the stirring member 3 and the inner circumference of the main casing 1 was 3.0 mm.

100 mass parts of magnetic toner particle 1, 2.00 mass parts of silica fine particle 1, and 0.50 mass parts of magnetic iron oxide particle 1 were introduced into the apparatus shown in FIG. 6 having the apparatus structure described above. Silica fine particle 1 was obtained by treating 100 mass parts of a silica with a BET of 130 $m^2/g$ and a primary particle number-average particle diameter (D1) of 16 nm with 10 mass parts hexamethyldisilazane and then with 10 mass parts dimethylsilicone oil.

A pre-mixing was carried out after introduction and prior to the external addition process in order to uniformly mix the magnetic toner particles and silica fine particles. The pre-mixing conditions were as follows: a drive member 8 power of 0.1 W/g (drive member 8 rotation rate of 150 rpm) and a processing time of 1 minute.

The external addition and mixing process was carried out once pre-mixing was finished. With regard to the conditions for the external addition and mixing process, the processing time was 5 minutes and the peripheral velocity of the outermost end of the stirring member 3 was adjusted to provide a constant drive member 8 power of 1.0 W/g (drive member 8 rotation rate of 1800 rpm). The conditions for the external addition and mixing process are shown in Table 3.

After the external addition and mixing process, the coarse particles and so forth were removed using a circular vibrating screen equipped with a screen having a diameter of 500 mm and an aperture of 75 μm to obtain magnetic toner 1. A value of 18 nm was obtained when magnetic toner 1 was submitted to magnification and observation with a scanning electron microscope and the number-average particle diameter of the primary particles of the silica fine particles on the magnetic toner surface was measured. The external addition conditions and properties of magnetic toner 1 are shown in Table 3 and Table 4, respectively.

<Magnetic Toner 2 Production Example>

100 mass parts of magnetic toner particle 1 and 2.00 mass parts of silica fine particle 2 were introduced into the apparatus shown in FIG. 6 having the external addition apparatus structure used in Magnetic Toner 1 Production Example. Silica fine particle 2 was obtained by treating 100 mass parts of a silica with a BET of 200 $m^2/g$ and a primary particle number-average particle diameter (D1) of 12 nm with 10 mass parts hexamethyldisilazane and then with 10 mass parts dimethylsilicone oil.

A pre-mixing was carried out after introduction and prior to the external addition process in order to uniformly mix the magnetic toner particles and the silica fine particles. The pre-mixing conditions were as follows: a drive member 8 power of 0.1 W/g (drive member 8 rotation rate of 150 rpm) and a processing time of 1 minute.

The external addition and mixing process was carried out once pre-mixing was finished. With regard to the conditions for the external addition and mixing process, the processing time was 5 minutes and the peripheral velocity of the outermost end of the stirring member 3 was adjusted to provide a constant drive member 8 power of 1.0 W/g (drive member 8 rotation rate of 1800 rpm). The conditions for the external addition and mixing process are shown in Table 3.

After the external addition and mixing process, 0.50 mass parts of magnetic iron oxide particle 1 was added and mixing was carried out for 3 minutes at 3000 rpm using an FM10C Henschel mixer (Mitsui Miike Chemical Engineering Machinery Co., Ltd.).

This was followed by removal of the coarse particles and so forth using a circular vibrating screen equipped with a screen having a diameter of 500 mm and an aperture of 75 μm to obtain magnetic toner 2. The external addition conditions for magnetic toner 2 are shown in Table 3 and the properties of magnetic toner 2 are shown in Table 4.

<Magnetic Toner 3 Production Example>

A magnetic toner 3 was obtained by following the same procedure as in Magnetic Toner 1 Production Example, with the exception that silica fine particle 2 was used in place of the silica fine particle 1. Silica fine particle 2 was obtained by performing the same surface treatment as with silica fine particle 1, but on a silica that had a BET specific area of 200 $m^2/g$ and a primary particle number-average particle diameter (D1) of 12 nm. A value of 14 nm was obtained when magnetic toner 3 was submitted to magnification and observation with a scanning electron microscope and the number-average particle diameter of the primary particles of the silica fine particles on the magnetic toner surface was measured. The external addition conditions for and properties of magnetic toner 3 are shown in Table 3 and Table 4, respectively.

<Magnetic Toner 4 Production Example>

A magnetic toner 4 was obtained by following the same procedure as in Magnetic Toner 1 Production Example, with the exception that silica fine particle 3 was used in place of the silica fine particle 1. Silica fine particle 3 was obtained by performing the same surface treatment as with silica fine particle 1, but on a silica that had a BET specific area of 90 $m^2/g$ and a primary particle number-average particle diameter (D1) of 25 nm. A value of 28 nm was obtained when magnetic toner 4 was submitted to magnification and observation with a scanning electron microscope and the number-average particle diameter of the primary particles of the silica fine particles on the magnetic toner surface was measured. The external addition conditions for and properties of magnetic toner 4 are shown in Table 3 and Table 4, respectively.

<Magnetic Toners 5 to 9 and 14 to 46 Production Examples and Comparative Magnetic Toners 1 to 19 and 21 to 40 Production Examples>

Magnetic toners 5 to 9 and 14 to 46 and comparative magnetic toners 1 to 19 and 21 to 40 were obtained using the magnetic toner particles shown in Table 3 in Magnetic Toner 1 Production Example in place of magnetic toner particle 1 and by performing respective external addition processing using the external addition formulations, external addition apparatuses, and external addition conditions shown in Table 3. The properties of these magnetic toners are shown in Table 4.

Anatase titanium oxide [BET specific surface area: 80 $m^2/g$, primary particle number-average particle diameter (D1): 15 nm, treated with 12 mass % isobutyltrimethoxysilane] was used for the titania fine particles referenced in Table 3 and alumina fine particles [BET specific surface area: 70 $m^2/g$, primary particle number-average particle diameter (D1): 17 nm, treated with 10 mass % isobutyltrimethoxysilane] were used for the alumina fine particles referenced in Table 3.

Table 3 gives the proportion (mass %) of silica fine particles for the addition of titania fine particles and/or alumina fine particles in addition to silica fine particles. For comparative magnetic toners 15 to 19, pre-mixing was not performed and the external addition and mixing process was carried out immediately after introduction. The hybridizer referenced in Table 3 is the Hybridizer Model 1 (Nara Machinery Co., Ltd.), and the Henschel mixer referenced in Table 3 is the FM10C (Mitsui Miike Chemical Engineering Machinery Co., Ltd.).

<Magnetic Toner 10 Production Example>

The external addition and mixing process was performed according to the following procedure using the same apparatus structure (apparatus in FIG. 6) as in Magnetic Toner 1 Production Example.

The silica fine particle 1 (2.00 mass parts) added in Magnetic Toner 1 Production Example was changed to silica fine particle 1 (1.70 mass parts) and titania fine particles (0.30 mass parts).

First, 100 mass parts of magnetic toner particle 1, 0.70 mass parts of silica fine particle 1, 0.30 mass parts of the titania fine particles, and 0.50 mass parts of magnetic iron oxide particle 1 were introduced and the same pre-mixing as in Magnetic Toner 1 Production Example was then performed.

In the external addition and mixing process carried out once pre-mixing was finished, processing was performed for a processing time of 2 minutes while adjusting the peripheral velocity of the outermost end of the stirring member 3 so as to provide a constant drive member 8 power of 1.0 W/g (drive member 8 rotation rate of 1800 rpm), after which the mixing process was temporarily stopped. The supplementary introduction of the remaining silica fine particle 1 (1.00 mass part with reference to 100 mass parts of magnetic toner particle) was then performed, followed by again processing for a processing time of 3 minutes while adjusting the peripheral velocity of the outermost end of the stirring member 3 so as to provide a constant drive member 8 power of 1.0 W/g (drive member 8 rotation rate of 1800 rpm), thus providing a total external addition and mixing process time of 5 minutes.

After the external addition and mixing process, the coarse particles and so forth were removed using a circular vibrating screen as in Magnetic Toner 1 Production Example to obtain magnetic toner 10. The external addition conditions for and physical properties of the magnetic toner 10 are given in Table 3 and Table 4 respectively.

<Magnetic Toner Production 11 Example>

The external addition and mixing process was performed according to the following procedure using the same apparatus structure (apparatus in FIG. 6) as in Magnetic Toner 1 Production Example.

The silica fine particle 1 (2.00 mass parts) added in Magnetic Toner 1 Production Example was changed to silica fine particle 1 (1.70 mass parts) and titania fine particles (0.30 mass parts).

First, 100 mass parts of magnetic toner particle 1, 1.70 mass parts of silica fine particle 1, and 0.50 mass parts of magnetic iron oxide particle 1 were introduced and the same pre-mixing as in Magnetic Toner 1 Production Example was then performed.

In the external addition and mixing process carried out once pre-mixing was finished, processing was performed for a processing time of 2 minutes while adjusting the peripheral velocity of the outermost end of the stirring member 3 so as to provide a constant drive member 8 power of 1.0 W/g (drive member 8 rotation rate of 1800 rpm), after which the mixing process was temporarily stopped. The supplementary introduction of the remaining titania fine particles (0.30 mass parts with reference to 100 mass parts of magnetic toner particle) was then performed, followed by again processing for a processing time of 3 minutes while adjusting the peripheral velocity of the outermost end of the stirring member 3 so as to provide a constant drive member 8 power of 1.0 W/g (drive member 8 rotation rate of 1800 rpm), thus providing a total external addition and mixing process time of 5 minutes.

After the external addition and mixing process, the coarse particles and so forth were removed using a circular vibrating screen as in Magnetic Toner 1 Production Example to obtain magnetic toner 11. The external addition conditions for and properties of magnetic toner 11 are shown in Table 3 and Table 4 respectively.

<Magnetic Toner Production 12 Example>

Magnetic toner 12 was obtained proceeding as in Magnetic Toner 1 Production Example, with the exception that the amount of addition of the silica fine particle 1 was changed to 1.80 mass parts. A value of 18 nm was obtained when magnetic toner 12 was submitted to magnification and observation with a scanning electron microscope and the number-average particle diameter of the primary particles of the silica fine particles on the magnetic toner surface was measured. The external addition conditions for and properties of magnetic toner 12 are shown in Table 3 and Table 4, respectively.

<Magnetic Toner 13 Production Example>

Magnetic toner 13 was obtained proceeding as in Magnetic Toner 4 Production Example, but changing the amount of addition of the silica fine particle 3 to 1.80 mass parts. A value of 28 nm was obtained when magnetic toner 13 was submitted to magnification and observation with a scanning electron microscope and the number-average particle diameter of the primary particles of the silica fine particles on the magnetic toner surface was measured. The external addition conditions for magnetic toner 13 are shown in Table 3 and the properties of magnetic toner 13 are shown in Table 4.

<Comparative Magnetic Toner 20 Production Example>

A comparative magnetic toner 20 was obtained by following the same procedure as in Comparative Magnetic Toner 17 Production Example, with the exception that silica fine particle 4 (2.00 mass parts) was used in place of the silica fine particle 1 (3.10 mass parts). Silica fine particle 4 was obtained by performing the same surface treatment as with silica fine particle 1, but on a silica that had a BET specific area of 30 $m^2/g$ and a primary particle number-average particle diameter (D1) of 51 nm. A value of 53 nm was obtained when comparative magnetic toner 20 was submitted to magnification and observation with a scanning electron microscope and the number-average particle diameter of the primary particles of the silica fine particles on the magnetic toner surface was measured. The external addition conditions for and properties of comparative magnetic toner 20 are shown in Table 3 and Table 4, respectively.

TABLE 3

| | | External additives | | | | |
|---|---|---|---|---|---|---|
| | | | | | Magnetic iron oxide particles | |
| | | Inorganic fine particles (mass parts) | | | | |
| | Magnetic toner particle | Silica fine particles | Titania fine particles | Alumina fine particles | Type | Amount of addition (mass parts) |
| Magnetic toner No. | | | | | | |
| 1 | Magnetic toner particle 1 | 2.00 | | | Magnetic iron oxide particle 1 | 0.50 |
| 2 | Magnetic toner particle 1 | 2.00 | | | Magnetic iron oxide particle 1 | 0.50 |
| 3 | Magnetic toner particle 1 | 2.00 | | | Magnetic iron oxide particle 1 | 0.50 |
| 4 | Magnetic toner particle 1 | 2.00 | | | Magnetic iron oxide particle 1 | 0.50 |
| 5 | Magnetic toner particle 2 | 2.00 | | | Magnetic iron oxide particle 1 | 0.50 |
| 6 | Magnetic toner particle 3 | 2.00 | | | Magnetic iron oxide particle 1 | 0.50 |
| 7 | Magnetic toner particle 4 | 2.18 | | | Magnetic iron oxide particle 1 | 0.50 |
| 8 | Magnetic toner particle 1 | 1.70 | 0.30 | | Magnetic iron oxide particle 1 | 0.50 |
| 9 | Magnetic toner particle 1 | 1.70 | 0.16 | 0.14 | Magnetic iron oxide particle 1 | 0.50 |
| 10 | Magnetic toner particle 1 | 1.70 | 0.30 | | Magnetic iron oxide particle 1 | 0.50 |
| 11 | Magnetic toner particle 1 | 1.70 | 0.30 | | Magnetic iron oxide particle 1 | 0.50 |
| 12 | Magnetic toner particle 1 | 1.80 | | | Magnetic iron oxide particle 1 | 0.50 |
| 13 | Magnetic toner particle 1 | 1.80 | | | Magnetic iron oxide particle 1 | 0.50 |
| 14 | Magnetic toner particle 1 | 1.50 | | | Magnetic iron oxide particle 1 | 0.50 |
| 15 | Magnetic toner particle 1 | 1.28 | 0.22 | | Magnetic iron oxide particle 1 | 0.50 |
| 16 | Magnetic toner particle 1 | 1.28 | 0.12 | 0.10 | Magnetic iron oxide particle 1 | 0.50 |
| 17 | Magnetic toner particle 1 | 2.60 | | | Magnetic iron oxide particle 1 | 0.50 |
| 18 | Magnetic toner particle 1 | 2.21 | 0.39 | | Magnetic iron oxide particle 1 | 0.50 |
| 19 | Magnetic toner particle 1 | 2.21 | 0.21 | 0.18 | Magnetic iron oxide particle 1 | 0.50 |
| 20 | Magnetic toner particle 2 | 1.50 | | | Magnetic iron oxide particle 1 | 0.10 |
| 21 | Magnetic toner particle 3 | 1.50 | | | Magnetic iron oxide particle 1 | 5.00 |
| 22 | Magnetic toner particle 4 | 1.63 | | | Magnetic iron oxide particle 1 | 0.10 |
| 23 | Magnetic toner particle 4 | 1.63 | | | Magnetic iron oxide particle 1 | 5.00 |
| 24 | Magnetic toner particle 2 | 1.50 | | | Magnetic iron oxide particle 1 | 0.10 |
| 25 | Magnetic toner particle 3 | 1.50 | | | Magnetic iron oxide particle 1 | 5.00 |
| 26 | Magnetic toner particle 4 | 1.63 | | | Magnetic iron oxide particle 1 | 0.10 |
| 27 | Magnetic toner particle 4 | 1.63 | | | Magnetic iron oxide particle 1 | 5.00 |
| 28 | Magnetic toner particle 2 | 2.60 | | | Magnetic iron oxide particle 1 | 0.10 |
| 29 | Magnetic toner particle 3 | 2.60 | | | Magnetic iron oxide particle 1 | 5.00 |
| 30 | Magnetic toner particle 4 | 2.83 | | | Magnetic iron oxide particle 1 | 0.10 |
| 31 | Magnetic toner particle 4 | 2.83 | | | Magnetic iron oxide particle 1 | 5.00 |
| 32 | Magnetic toner particle 2 | 2.60 | | | Magnetic iron oxide particle 1 | 0.10 |
| 33 | Magnetic toner particle 3 | 2.60 | | | Magnetic iron oxide particle 1 | 5.00 |
| 34 | Magnetic toner particle 4 | 2.83 | | | Magnetic iron oxide particle 1 | 0.10 |
| 35 | Magnetic toner particle 4 | 2.83 | | | Magnetic iron oxide particle 1 | 5.00 |
| 36 | Magnetic toner particle 2 | 2.60 | | | Magnetic iron oxide particle 2 | 0.10 |
| 37 | Magnetic toner particle 4 | 2.83 | | | Magnetic iron oxide particle 3 | 0.50 |
| 38 | Magnetic toner particle 4 | 2.83 | | | Magnetic iron oxide particle 4 | 0.50 |
| 39 | Magnetic toner particle 4 | 2.83 | | | Magnetic iron oxide particle 5 | 0.50 |
| 40 | Magnetic toner particle 4 | 2.83 | | | Magnetic iron oxide particle 6 | 0.50 |
| 41 | Magnetic toner particle 5 | 2.18 | | | Magnetic iron oxide particle 6 | 0.50 |
| 42 | Magnetic toner particle 6 | 2.18 | | | Magnetic iron oxide particle 6 | 0.50 |
| 43 | Magnetic toner particle 11 | 2.09 | | | Magnetic iron oxide particle 6 | 0.50 |
| 44 | Magnetic toner particle 7 | 2.23 | | | Magnetic iron oxide particle 6 | 0.50 |
| 45 | Magnetic toner particle 7 | 2.31 | | | Magnetic iron oxide particle 6 | 0.50 |
| 46 | Magnetic toner particle 7 | 2.31 | | | Magnetic iron oxide particle 6 | 0.50 |
| Comparative magnetic toner No. | | | | | | |
| 1 | Magnetic toner particle 1 | 1.50 | | | Magnetic iron oxide particle 1 | 0.50 |
| 2 | Magnetic toner particle 1 | 1.50 | | | Magnetic iron oxide particle 1 | 0.50 |
| 3 | Magnetic toner particle 1 | 2.60 | | | Magnetic iron oxide particle 1 | 0.50 |
| 4 | Magnetic toner particle 1 | 2.60 | | | Magnetic iron oxide particle 1 | 0.50 |
| 5 | Magnetic toner particle 1 | 3.50 | | | Magnetic iron oxide particle 1 | 0.50 |
| 6 | Magnetic toner particle 1 | 1.50 | | | Magnetic iron oxide particle 1 | 0.50 |
| 7 | Magnetic toner particle 1 | 1.50 | | | Magnetic iron oxide particle 1 | 0.50 |
| 8 | Magnetic toner particle 8 | 1.00 | | | Magnetic iron oxide particle 1 | 0.50 |
| 9 | Magnetic toner particle 8 | 2.00 | | | Magnetic iron oxide particle 1 | 0.50 |
| 10 | Magnetic toner particle 9 | 1.00 | | | Magnetic iron oxide particle 1 | 0.50 |
| 11 | Magnetic toner particle 9 | 2.00 | | | Magnetic iron oxide particle 1 | 0.50 |
| 12 | Magnetic toner particle 10 | 2.00 | | | Magnetic iron oxide particle 1 | 0.50 |
| 13 | Magnetic toner particle 1 | 1.60 | 0.40 | | Magnetic iron oxide particle 1 | 0.50 |
| 14 | Magnetic toner particle 1 | 1.60 | 0.20 | 0.20 | Magnetic iron oxide particle 1 | 0.50 |

TABLE 3-continued

| | | | | |
|---|---|---|---|---|
| 15 | Magnetic toner particle 1 | 1.50 | Magnetic iron oxide particle 1 | 0.50 |
| 16 | Magnetic toner particle 1 | 1.20 | Magnetic iron oxide particle 1 | 0.50 |
| 17 | Magnetic toner particle 1 | 3.10 | Magnetic iron oxide particle 1 | 0.50 |
| 18 | Magnetic toner particle 1 | 2.60 | Magnetic iron oxide particle 1 | 0.50 |
| 19 | Magnetic toner particle 1 | 1.50 | Magnetic iron oxide particle 1 | 0.50 |
| 20 | Magnetic toner particle 1 | 2.00 | Magnetic iron oxide particle 1 | 0.50 |
| 21 | Magnetic toner particle 2 | 2.00 | Magnetic iron oxide particle 1 | 0.08 |
| 22 | Magnetic toner particle 3 | 2.00 | Magnetic iron oxide particle 1 | 5.10 |
| 23 | Magnetic toner particle 4 | 2.18 | Magnetic iron oxide particle 1 | 0.08 |
| 24 | Magnetic toner particle 4 | 2.18 | Magnetic iron oxide particle 1 | 5.10 |
| 25 | Magnetic toner particle 2 | 1.50 | Magnetic iron oxide particle 1 | 0.08 |
| 26 | Magnetic toner particle 3 | 1.50 | Magnetic iron oxide particle 1 | 5.10 |
| 27 | Magnetic toner particle 4 | 1.63 | Magnetic iron oxide particle 1 | 0.08 |
| 28 | Magnetic toner particle 4 | 1.63 | Magnetic iron oxide particle 1 | 5.10 |
| 29 | Magnetic toner particle 2 | 1.50 | Magnetic iron oxide particle 1 | 0.08 |
| 30 | Magnetic toner particle 3 | 1.50 | Magnetic iron oxide particle 1 | 5.10 |
| 31 | Magnetic toner particle 4 | 1.63 | Magnetic iron oxide particle 1 | 0.08 |
| 32 | Magnetic toner particle 4 | 1.63 | Magnetic iron oxide particle 1 | 5.10 |
| 33 | Magnetic toner particle 2 | 2.60 | Magnetic iron oxide particle 1 | 0.08 |
| 34 | Magnetic toner particle 3 | 2.60 | Magnetic iron oxide particle 1 | 5.10 |
| 35 | Magnetic toner particle 4 | 2.83 | Magnetic iron oxide particle 1 | 0.08 |
| 36 | Magnetic toner particle 4 | 2.83 | Magnetic iron oxide particle 1 | 5.10 |
| 37 | Magnetic toner particle 2 | 2.60 | Magnetic iron oxide particle 1 | 0.08 |
| 38 | Magnetic toner particle 3 | 2.60 | Magnetic iron oxide particle 1 | 5.10 |
| 39 | Magnetic toner particle 4 | 2.83 | Magnetic iron oxide particle 1 | 0.08 |
| 40 | Magnetic toner particle 4 | 2.83 | Magnetic iron oxide particle 1 | 5.10 |

| | Content of silica fine particles (mass %) | Content of silica fine particles in the fixed inorganic fine particles (mass %) | External addition conditions for the inorganic fine particles and so forth | | | External addition conditions for the magnetic iron oxide particles |
|---|---|---|---|---|---|---|
| Magnetic toner No. | | | External addition apparatus | Mixing conditions | Mixing time | |
| 1 | 100 | 100 | FIG. 6 | 1.0 W/g (1800 rpm) | 5 min | A |
| 2 | 100 | 100 | FIG. 6 | 1.0 W/g (1800 rpm) | 5 min | B |
| 3 | 100 | 100 | FIG. 6 | 1.0 W/g (1800 rpm) | 5 min | A |
| 4 | 100 | 100 | FIG. 6 | 1.0 W/g (1800 rpm) | 5 min | A |
| 5 | 100 | 100 | FIG. 6 | 1.0 W/g (1800 rpm) | 5 min | A |
| 6 | 100 | 100 | FIG. 6 | 1.0 W/g (1800 rpm) | 5 min | A |
| 7 | 100 | 100 | FIG. 6 | 1.0 W/g (1800 rpm) | 5 min | A |
| 8 | 85 | 85 | FIG. 6 | 1.0 W/g (1800 rpm) | 5 min | A |
| 9 | 85 | 85 | FIG. 6 | 1.0 W/g (1800 rpm) | 5 min | A |
| 10 | 85 | 80 | FIG. 6 | 1.0 W/g (1800 rpm) | 5 min | A |
| 11 | 85 | 90 | FIG. 6 | 1.0 W/g (1800 rpm) | 5 min | A |
| 12 | 100 | 100 | FIG. 6 | 1.0 W/g (1800 rpm) | 5 min | A |
| 13 | 100 | 100 | FIG. 6 | 1.0 W/g (1800 rpm) | 5 min | A |
| 14 | 100 | 100 | FIG. 6 | 1.0 W/g (1800 rpm) | 5 min | A |
| 15 | 85 | 85 | FIG. 6 | 1.0 W/g (1800 rpm) | 5 min | A |
| 16 | 85 | 85 | FIG. 6 | 1.0 W/g (1800 rpm) | 5 min | A |
| 17 | 100 | 100 | FIG. 6 | 1.0 W/g (1800 rpm) | 5 min | A |
| 18 | 85 | 85 | FIG. 6 | 1.0 W/g (1800 rpm) | 5 min | A |
| 19 | 85 | 85 | FIG. 6 | 1.0 W/g (1800 rpm) | 5 min | A |
| 20 | 100 | 100 | FIG. 6 | 1.6 W/g (2560 rpm) | 5 min | A |
| 21 | 100 | 100 | FIG. 6 | 1.6 W/g (2560 rpm) | 5 min | A |
| 22 | 100 | 100 | FIG. 6 | 1.6 W/g (2560 rpm) | 5 min | A |
| 23 | 100 | 100 | FIG. 6 | 1.6 W/g (2560 rpm) | 5 min | A |
| 24 | 100 | 100 | FIG. 6 | 0.6 W/g (1300 rpm) | 5 min | A |
| 25 | 100 | 100 | FIG. 6 | 0.6 W/g (1300 rpm) | 5 min | A |
| 26 | 100 | 100 | FIG. 6 | 0.6 W/g (1300 rpm) | 5 min | A |
| 27 | 100 | 100 | FIG. 6 | 0.6 W/g (1300 rpm) | 5 min | A |
| 28 | 100 | 100 | FIG. 6 | 1.6 W/g (2560 rpm) | 5 min | A |
| 29 | 100 | 100 | FIG. 6 | 1.6 W/g (2560 rpm) | 5 min | A |
| 30 | 100 | 100 | FIG. 6 | 1.6 W/g (2560 rpm) | 5 min | A |
| 31 | 100 | 100 | FIG. 6 | 1.6 W/g (2560 rpm) | 5 min | A |
| 32 | 100 | 100 | FIG. 6 | 0.6 W/g (1300 rpm) | 5 min | A |
| 33 | 100 | 100 | FIG. 6 | 0.6 W/g (1300 rpm) | 5 min | A |
| 34 | 100 | 100 | FIG. 6 | 0.6 W/g (1300 rpm) | 5 min | A |
| 35 | 100 | 100 | FIG. 6 | 0.6 W/g (1300 rpm) | 5 min | A |
| 36 | 100 | 100 | FIG. 6 | 0.6 W/g (1300 rpm) | 5 min | A |
| 37 | 100 | 100 | FIG. 6 | 0.6 W/g (1300 rpm) | 5 min | A |

TABLE 3-continued

| | | | | | | |
|---|---|---|---|---|---|---|
| 38 | 100 | 100 | FIG. 6 | 0.6 W/g (1300 rpm) | 5 min | A |
| 39 | 100 | 100 | FIG. 6 | 0.6 W/g (1300 rpm) | 5 min | A |
| 40 | 100 | 100 | FIG. 6 | 0.6 W/g (1300 rpm) | 5 min | A |
| 41 | 100 | 100 | FIG. 6 | 1.0 W/g (1800 rpm) | 5 min | A |
| 42 | 100 | 100 | FIG. 6 | 1.0 W/g (1800 rpm) | 5 min | A |
| 43 | 100 | 100 | FIG. 6 | 1.0 W/g (1800 rpm) | 5 min | A |
| 44 | 100 | 100 | FIG. 6 | 1.0 W/g (1800 rpm) | 5 min | A |
| 45 | 100 | 100 | Hybridizer | 6000 rpm | 5 min | A |
| 46 | 100 | 100 | Hybridizer | 7000 rpm | 5 min | A |
| Comparative magnetic toner No. | | | | | | |
| 1 | 100 | 100 | Henschel mixer 3000 rpm | | 2 min | A |
| 2 | 100 | 100 | Henschel mixer 4000 rpm | | 5 min | A |
| 3 | 100 | 100 | Henschel mixer 3000 rpm | | 2 min | A |
| 4 | 100 | 100 | Henschel mixer 4000 rpm | | 5 min | A |
| 5 | 100 | 100 | Henschel mixer 3000 rpm | | 2 min | A |
| 6 | 100 | 100 | Hybridizer | 6000 rpm | 5 min | A |
| 7 | 100 | 100 | Hybridizer | 7000 rpm | 8 min | A |
| 8 | 100 | 100 | Henschel mixer 4000 rpm | | 2 min | A |
| 9 | 100 | 100 | Henschel mixer 4000 rpm | | 2 min | A |
| 10 | 100 | 100 | Henschel mixer 4000 rpm | | 2 min | A |
| 11 | 100 | 100 | Henschel mixer 4000 rpm | | 2 min | A |
| 12 | 100 | 100 | Henschel mixer 4000 rpm | | 2 min | A |
| 13 | 80 | 80 | FIG. 6 | 1.0 W/g (1800 rpm) | 5 min | A |
| 14 | 80 | 80 | FIG. 6 | 1.0 W/g (1800 rpm) | 5 min | A |
| 15 | 100 | 100 | FIG. 6 | No pre-mixing 0.6 W/g (1300 rpm) | 3 min | A |
| 16 | 100 | 100 | FIG. 6 | No pre-mixing 0.6 W/g (1300 rpm) | 3 min | A |
| 17 | 100 | 100 | FIG. 6 | No pre-mixing 1.6 W/g (2560 rpm) | 3 min | A |
| 18 | 100 | 100 | FIG. 6 | No pre-mixing 0.6 W/g (1300 rpm) | 3 min | A |
| 19 | 100 | 100 | FIG. 6 | No pre-mixing 2.2 W/g (3300 rpm) | 5 min | A |
| 20 | 100 | 100 | FIG. 6 | 1.0 W/g (1800 rpm) | 5 min | A |
| 21 | 100 | 100 | FIG. 6 | 1.0 W/g (1800 rpm) | 5 min | A |
| 22 | 100 | 100 | FIG. 6 | 1.0 W/g (1800 rpm) | 5 min | A |
| 23 | 100 | 100 | FIG. 6 | 1.0 W/g (1800 rpm) | 5 min | A |
| 24 | 100 | 100 | FIG. 6 | 1.0 W/g (1800 rpm) | 5 min | A |
| 25 | 100 | 100 | FIG. 6 | 1.6 W/g (2560 rpm) | 5 min | A |
| 26 | 100 | 100 | FIG. 6 | 1.6 W/g (2560 rpm) | 5 min | A |
| 27 | 100 | 100 | FIG. 6 | 1.6 W/g (2560 rpm) | 5 min | A |
| 28 | 100 | 100 | FIG. 6 | 1.6 W/g (2560 rpm) | 5 min | A |
| 29 | 100 | 100 | FIG. 6 | 0.6 W/g (1300 rpm) | 5 min | A |
| 30 | 100 | 100 | FIG. 6 | 0.6 W/g (1300 rpm) | 5 min | A |
| 31 | 100 | 100 | FIG. 6 | 0.6 W/g (1300 rpm) | 5 min | A |
| 32 | 100 | 100 | FIG. 6 | 0.6 W/g (1300 rpm) | 5 min | A |
| 33 | 100 | 100 | FIG. 6 | 1.6 W/g (2560 rpm) | 5 min | A |
| 34 | 100 | 100 | FIG. 6 | 1.6 W/g (2560 rpm) | 5 min | A |
| 35 | 100 | 100 | FIG. 6 | 1.6 W/g (2560 rpm) | 5 min | A |
| 36 | 100 | 100 | FIG. 6 | 1.6 W/g (2560 rpm) | 5 min | A |
| 37 | 100 | 100 | FIG. 6 | 0.6 W/g (1300 rpm) | 5 min | A |
| 38 | 100 | 100 | FIG. 6 | 0.6 W/g (1300 rpm) | 5 min | A |
| 39 | 100 | 100 | FIG. 6 | 0.6 W/g (1300 rpm) | 5 min | A |
| 40 | 100 | 100 | FIG. 6 | 0.6 W/g (1300 rpm) | 5 min | A |

A: External addition by addition at the same time as the inorganic fine particles B: External addition with Henschel mixer with addition after external addition of the inorganic fine particles

TABLE 4

| Magnetic toner No. | Magnetic iron oxide particles present on the magnetic toner particles' surface (mass %) | Coverage ratio A (%) | B/A | Coefficient of variation on coverage ratio A (%) | Dielectric constant ϵ' (pF/m) | Average circularity |
|---|---|---|---|---|---|---|
| 1 | 0.50 | 55.1 | 0.69 | 6.4 | 46.0 | 0.946 |
| 2 | 0.51 | 54.8 | 0.69 | 6.5 | 45.8 | 0.946 |
| 3 | 0.51 | 58.1 | 0.72 | 6.2 | 45.9 | 0.946 |

TABLE 4-continued

| | Magnetic iron oxide particles present on the magnetic toner particles' surface (mass %) | Coverage ratio A (%) | B/A | Coefficient of variation on coverage ratio A (%) | Dielectric constant ϵ' (pF/m) | Average circularity |
|---|---|---|---|---|---|---|
| 4 | 0.49 | 50.2 | 0.63 | 9.2 | 45.8 | 0.946 |
| 5 | 0.51 | 54.9 | 0.69 | 6.7 | 46.0 | 0.935 |
| 6 | 0.50 | 55.6 | 0.67 | 6.8 | 45.9 | 0.955 |
| 7 | 0.51 | 55.1 | 0.69 | 6.5 | 40.0 | 0.946 |
| 8 | 0.51 | 54.7 | 0.68 | 6.6 | 46.1 | 0.946 |
| 9 | 0.51 | 55.3 | 0.69 | 6.7 | 46.0 | 0.946 |
| 10 | 0.49 | 54.1 | 0.67 | 6.5 | 45.9 | 0.946 |
| 11 | 0.48 | 55.1 | 0.69 | 6.6 | 46.0 | 0.946 |
| 12 | 0.49 | 50.3 | 0.69 | 6.5 | 46.0 | 0.946 |
| 13 | 0.50 | 46.9 | 0.64 | 9.8 | 46.1 | 0.946 |
| 14 | 0.51 | 45.5 | 0.72 | 6.7 | 46.1 | 0.946 |
| 15 | 0.50 | 45.6 | 0.72 | 6.8 | 46.0 | 0.946 |
| 16 | 0.49 | 45.4 | 0.71 | 6.8 | 45.9 | 0.946 |
| 17 | 0.49 | 68.4 | 0.67 | 6.4 | 45.9 | 0.946 |
| 18 | 0.50 | 68.8 | 0.69 | 6.6 | 46.0 | 0.946 |
| 19 | 0.50 | 67.8 | 0.68 | 6.5 | 46.1 | 0.946 |
| 20 | 0.10 | 45.3 | 0.84 | 6.6 | 45.8 | 0.935 |
| 21 | 5.00 | 46.0 | 0.83 | 6.5 | 45.9 | 0.955 |
| 22 | 0.10 | 45.2 | 0.84 | 6.6 | 39.9 | 0.946 |
| 23 | 4.90 | 45.1 | 0.84 | 6.6 | 40.0 | 0.946 |
| 24 | 0.10 | 45.9 | 0.52 | 7.1 | 46.0 | 0.935 |
| 25 | 5.00 | 46.0 | 0.53 | 6.9 | 45.8 | 0.955 |
| 26 | 0.10 | 45.2 | 0.52 | 7.1 | 40.0 | 0.946 |
| 27 | 4.80 | 45.1 | 0.52 | 7.1 | 40.1 | 0.946 |
| 28 | 0.10 | 69.1 | 0.84 | 6.1 | 46.0 | 0.935 |
| 29 | 4.90 | 68.8 | 0.83 | 6.5 | 46.0 | 0.955 |
| 30 | 0.10 | 69.1 | 0.84 | 6.1 | 40.0 | 0.946 |
| 31 | 5.00 | 69.0 | 0.84 | 6.1 | 40.1 | 0.946 |
| 32 | 0.10 | 69.0 | 0.52 | 6.6 | 46.0 | 0.935 |
| 33 | 5.00 | 68.9 | 0.53 | 6.7 | 45.8 | 0.955 |
| 34 | 0.10 | 69.0 | 0.52 | 6.5 | 40.0 | 0.946 |
| 35 | 4.90 | 68.9 | 0.52 | 6.6 | 39.9 | 0.946 |
| 36 | 0.11 | 69.0 | 0.52 | 6.7 | 46.0 | 0.935 |
| 37 | 0.50 | 69.0 | 0.52 | 6.6 | 39.9 | 0.946 |
| 38 | 0.49 | 68.8 | 0.52 | 6.7 | 40.0 | 0.946 |
| 39 | 0.49 | 68.9 | 0.52 | 6.6 | 40.1 | 0.946 |
| 40 | 0.50 | 69.0 | 0.52 | 6.6 | 40.0 | 0.946 |
| 41 | 0.50 | 54.6 | 0.69 | 6.2 | 40.2 | 0.932 |
| 42 | 0.49 | 55.1 | 0.70 | 6.4 | 40.0 | 0.957 |
| 43 | 0.48 | 55.1 | 0.70 | 6.4 | 43.0 | 0.931 |
| 44 | 0.49 | 54.7 | 0.69 | 6.4 | 39.0 | 0.932 |
| 45 | 0.50 | 55.5 | 0.69 | 12.4 | 39.1 | 0.932 |
| 46 | 0.51 | 55.0 | 0.70 | 11.2 | 39.0 | 0.932 |
| Comparative magnetic toner No. | | | | | | |
| 1 | 0.51 | 36.0 | 0.41 | 17.8 | 46.1 | 0.946 |
| 2 | 0.49 | 38.1 | 0.42 | 18.1 | 46.2 | 0.946 |
| 3 | 0.50 | 50.1 | 0.35 | 13.1 | 46.0 | 0.946 |
| 4 | 0.50 | 52.3 | 0.36 | 12.0 | 45.9 | 0.946 |
| 5 | 0.50 | 72.0 | 0.45 | 14.0 | 45.9 | 0.946 |
| 6 | 0.50 | 43.4 | 0.83 | 13.3 | 45.8 | 0.946 |
| 7 | 0.51 | 44.6 | 0.85 | 12.6 | 46.0 | 0.946 |
| 8 | 0.52 | 42.5 | 0.47 | 15.1 | 46.0 | 0.971 |
| 9 | 0.49 | 55.2 | 0.48 | 14.7 | 45.7 | 0.970 |
| 10 | 0.48 | 63.0 | 0.88 | 13.1 | 46.0 | 0.971 |
| 11 | 0.50 | 71.4 | 0.82 | 12.9 | 45.8 | 0.970 |
| 12 | 0.50 | 72.0 | 0.88 | 12.9 | 45.9 | 0.970 |
| 13 | 0.49 | 54.0 | 0.68 | 7.9 | 46.0 | 0.946 |
| 14 | 0.50 | 53.3 | 0.65 | 8.8 | 46.1 | 0.946 |
| 15 | 0.50 | 46.1 | 0.47 | 12.3 | 46.0 | 0.946 |
| 16 | 0.52 | 43.0 | 0.53 | 13.4 | 46.0 | 0.946 |
| 17 | 0.50 | 73.1 | 0.53 | 12.3 | 45.8 | 0.946 |
| 18 | 0.51 | 68.1 | 0.47 | 11.9 | 45.9 | 0.946 |
| 19 | 0.50 | 46.9 | 0.88 | 12.5 | 46.0 | 0.946 |
| 20 | 0.50 | 35.8 | 0.48 | 10.2 | 46.0 | 0.946 |
| 21 | 0.08 | 55.1 | 0.70 | 6.6 | 46.1 | 0.935 |
| 22 | 5.10 | 55.5 | 0.69 | 6.5 | 46.0 | 0.955 |
| 23 | 0.08 | 55.1 | 0.70 | 6.6 | 40.0 | 0.946 |
| 24 | 5.20 | 55.5 | 0.69 | 6.5 | 39.9 | 0.946 |
| 25 | 0.07 | 45.9 | 0.84 | 6.5 | 46.0 | 0.935 |
| 26 | 5.10 | 46.2 | 0.83 | 6.2 | 46.1 | 0.955 |

TABLE 4-continued

| | Magnetic iron oxide particles present on the magnetic toner particles' surface (mass %) | Coverage ratio A (%) | B/A | Coefficient of variation on coverage ratio A (%) | Dielectric constant ε' (pF/m) | Average circularity |
|---|---|---|---|---|---|---|
| 27 | 0.07 | 45.9 | 0.84 | 6.5 | 40.0 | 0.946 |
| 28 | 5.10 | 46.2 | 0.83 | 6.2 | 40.1 | 0.946 |
| 29 | 0.08 | 45.5 | 0.52 | 6.5 | 46.0 | 0.935 |
| 30 | 5.20 | 46.0 | 0.52 | 6.6 | 45.9 | 0.955 |
| 31 | 0.08 | 45.5 | 0.52 | 6.5 | 40.0 | 0.946 |
| 32 | 5.10 | 46.0 | 0.52 | 6.6 | 39.9 | 0.946 |
| 33 | 0.08 | 69.1 | 0.82 | 6.1 | 46.0 | 0.935 |
| 34 | 5.20 | 68.5 | 0.84 | 6.9 | 46.1 | 0.955 |
| 35 | 0.08 | 69.1 | 0.82 | 6.1 | 40.0 | 0.946 |
| 36 | 5.10 | 68.5 | 0.84 | 6.9 | 39.8 | 0.946 |
| 37 | 0.08 | 69.3 | 0.52 | 6.4 | 45.9 | 0.935 |
| 38 | 5.20 | 69.0 | 0.51 | 6.6 | 46.0 | 0.955 |
| 39 | 0.07 | 69.3 | 0.52 | 6.4 | 40.0 | 0.946 |
| 40 | 5.10 | 69.0 | 0.51 | 6.6 | 39.8 | 0.946 |

Example 1

The Image-Forming Apparatus

The image-forming apparatus was an LBP-3100 (Canon, Inc.), which was equipped with a toner carrying member that had a diameter of 10 mm; it was modified by connection to an external power source so that its transfer bias could be modified. Discharge is facilitated by a high transfer bias, enabling rigorous evaluation of the transfer defects. In addition, the transferability is generally severely tasked under a high-humidity environment. Using this modified apparatus and magnetic toner 1, a 1500-sheet image printing test was performed in one-sheet intermittent mode of horizontal lines at a print percentage of 2% in a high-temperature, high-humidity environment (32.5° C./80% RH) at an ordinary transfer bias (0.5 kV). After the 1500 sheets had been printed, a single print of a solid black image was output. The transfer bias was subsequently set to 1.5 kV and a solid black image was output.

On the other hand, using this modified apparatus and magnetic toner 1, a 1500-sheet image printing test was performed in one-sheet intermittent mode of horizontal lines at a print percentage of 2% in a normal-temperature, normal-humidity environment (23.0° C./50% RH) at an ordinary transfer bias (1 kV). After the 1500 sheets had been printed, a single print of a solid black image was output. The transfer bias was subsequently set to 1.5 kV and a solid black image was output.

According to the results, both before and after the durability test, an image could be obtained that had a high image density, was free of transfer defects, and also presented little fogging in the nonimage areas. The results of the evaluation are shown in Table 5.

The evaluation methods and associated scales used in the evaluations carried out in the examples of the present invention and comparative examples are described below.

<Image Density>

For the image density, the image density of a solid black image output at an ordinary transfer bias was measured with a MacBeth reflection densitometer (MacBeth Corporation). An image density of at least 1.45 was scored as very good; an image density of at least 1.35 was scored as good; and an image density of at least 1.30 was scored as a practically usable level.

<Fogging>

A white image was output and its reflectance was measured using a REFLECTMETER MODEL TC-6DS from Tokyo Denshoku Co., Ltd. On the other hand, the reflectance was also similarly measured on the transfer paper (standard paper) prior to formation of the white image. A green filter was used as the filter. The fogging was calculated using the following formula from the reflectance before output of the white image and the reflectance after output of the white image.

fogging (reflectance) (%)=reflectance (%) of the standard paper−reflectance (%) of the white image sample The scale for evaluating the fogging is below.

A: very good (less than 0.5%)

B: good (less than 1.0% but greater than or equal to 0.5%)

C: average (less than 1.5% and greater than or equal to 1.0%)

D: poor (greater than or equal to 1.5%)

<Transfer Defects>

A solid black image output with the above-described transfer bias changed to 1.5 kV was visually evaluated. Since the occurrence of the previously described discharge is facilitated at a high transfer bias, the transferability can thus be rigorously evaluated.

A: very good (transfer defects not produced).

B: some image density non-uniformity is present, but the image is unproblematic from a practical standpoint.

C: image density non-uniformity is seen over the entire surface, but the image is unproblematic from a practical standpoint.

D: a distinct image density non-uniformity is seen. The image is undesirable from a practical standpoint.

E: White void areas are seen on the solid black image. The image is undesirable from a practical standpoint.

Examples 2 to 46

Image output testing was performed as in Example 1, but using magnetic toners 2 to 46. According to the results, all of the magnetic toners provided images at at least practically unproblematic levels in pre- and post-durability testing. The results of the evaluations are shown in Table 5.

Comparative Examples 1 to 40

Image output testing was performed as in Example 1, but using comparative magnetic toners 1 to 40. The results of the evaluations are shown in Table 5.

TABLE 5

| | | Normal-temperature, normal-humidity environment | | | High-temperature, high-humidity environment | | |
|---|---|---|---|---|---|---|---|
| | | Density | Fogging | Transfer defects | Density | Fogging | Transfer defects |
| | Magnetic toner No. | | | | | | |
| Example 1 | 1 | 1.50 | 0.4 | A | 1.51 | 0.4 | A |
| Example 2 | 2 | 1.51 | 0.4 | A | 1.49 | 0.5 | A |
| Example 3 | 3 | 1.49 | 0.4 | A | 1.48 | 0.6 | A |
| Example 4 | 4 | 1.49 | 0.5 | A | 1.48 | 0.6 | A |
| Example 5 | 5 | 1.48 | 0.4 | A | 1.46 | 0.6 | A |
| Example 6 | 6 | 1.47 | 0.3 | A | 1.46 | 0.5 | A |
| Example 7 | 7 | 1.50 | 0.6 | A | 1.49 | 0.6 | B |
| Example 8 | 8 | 1.46 | 0.4 | A | 1.44 | 0.6 | A |
| Example 9 | 9 | 1.45 | 0.4 | A | 1.43 | 0.6 | A |
| Example 10 | 10 | 1.43 | 0.4 | A | 1.42 | 0.6 | A |
| Example 11 | 11 | 1.42 | 0.5 | A | 1.43 | 0.6 | A |
| Example 12 | 12 | 1.50 | 0.4 | A | 1.51 | 0.6 | A |
| Example 13 | 13 | 1.49 | 0.4 | A | 1.51 | 0.6 | A |
| Example 14 | 14 | 1.39 | 0.8 | A | 1.35 | 0.7 | A |
| Example 15 | 15 | 1.37 | 0.7 | A | 1.35 | 0.8 | A |
| Example 16 | 16 | 1.37 | 0.8 | A | 1.36 | 0.8 | A |
| Example 17 | 17 | 1.43 | 0.5 | A | 1.44 | 0.6 | A |
| Example 18 | 18 | 1.40 | 0.6 | A | 1.39 | 0.7 | A |
| Example 19 | 19 | 1.39 | 0.6 | A | 1.38 | 0.6 | A |
| Example 20 | 20 | 1.39 | 0.8 | A | 1.35 | 0.7 | A |
| Example 21 | 21 | 1.38 | 0.8 | A | 1.35 | 0.7 | A |
| Example 22 | 22 | 1.37 | 0.8 | A | 1.35 | 0.6 | B |
| Example 23 | 23 | 1.39 | 0.7 | A | 1.35 | 0.6 | B |
| Example 24 | 24 | 1.38 | 0.8 | A | 1.35 | 0.7 | A |
| Example 25 | 25 | 1.38 | 0.8 | A | 1.34 | 0.7 | A |
| Example 26 | 26 | 1.37 | 0.8 | A | 1.35 | 0.7 | B |
| Example 27 | 27 | 1.38 | 0.7 | A | 1.35 | 0.7 | B |
| Example 28 | 28 | 1.50 | 0.4 | A | 1.51 | 0.6 | A |
| Example 29 | 29 | 1.49 | 0.4 | A | 1.50 | 0.6 | A |
| Example 30 | 30 | 1.49 | 0.4 | A | 1.50 | 0.6 | B |
| Example 31 | 31 | 1.48 | 0.4 | A | 1.49 | 0.6 | B |
| Example 32 | 32 | 1.50 | 0.4 | A | 1.50 | 0.6 | A |
| Example 33 | 33 | 1.51 | 0.4 | A | 1.50 | 0.6 | A |
| Example 34 | 34 | 1.50 | 0.4 | A | 1.49 | 0.6 | B |
| Example 35 | 35 | 1.49 | 0.4 | A | 1.48 | 0.6 | B |
| Example 36 | 36 | 1.32 | 0.5 | A | 1.31 | 0.6 | A |
| Example 37 | 37 | 1.31 | 0.4 | A | 1.31 | 0.6 | B |
| Example 38 | 38 | 1.31 | 0.4 | A | 1.30 | 0.6 | B |
| Example 39 | 39 | 1.32 | 1.1 | A | 1.31 | 0.9 | B |
| Example 40 | 40 | 1.31 | 1.1 | A | 1.31 | 0.8 | B |
| Example 41 | 41 | 1.31 | 1.2 | B | 1.30 | 0.8 | B |
| Example 42 | 42 | 1.32 | 1.2 | B | 1.31 | 0.7 | B |
| Example 43 | 43 | 1.31 | 1.1 | A | 1.30 | 0.7 | B |
| Example 44 | 44 | 1.32 | 1.1 | B | 1.30 | 0.8 | C |
| Example 45 | 45 | 1.32 | 1.2 | C | 1.31 | 0.8 | C |
| Example 46 | 46 | 1.32 | 1.3 | C | 1.31 | 0.9 | C |
| | Comparative magnetic toner No. | | | | | | |
| Comparative Example 1 | 1 | 1.35 | 0.7 | D | 1.35 | 0.6 | D |
| Comparative Example 2 | 2 | 1.33 | 0.8 | D | 1.35 | 0.7 | D |
| Comparative Example 3 | 3 | 1.50 | 0.4 | D | 1.51 | 0.6 | D |
| Comparative Example 4 | 4 | 1.50 | 0.4 | D | 1.51 | 0.6 | D |
| Comparative Example 5 | 5 | 1.50 | 0.4 | D | 1.51 | 0.6 | D |
| Comparative Example 6 | 6 | 1.35 | 0.7 | C | 1.35 | 0.7 | D |
| Comparative Example 7 | 7 | 1.36 | 0.6 | C | 1.35 | 0.6 | D |
| Comparative Example 8 | 8 | 1.35 | 0.6 | D | 1.34 | 0.6 | E |
| Comparative Example 9 | 9 | 1.50 | 0.4 | D | 1.51 | 0.6 | D |
| Comparative Example 10 | 10 | 1.36 | 0.6 | D | 1.34 | 0.7 | D |
| Comparative Example 11 | 11 | 1.50 | 0.4 | D | 1.51 | 0.6 | D |
| Comparative Example 12 | 12 | 1.50 | 0.4 | D | 1.51 | 0.6 | E |
| Comparative Example 13 | 13 | 1.33 | 0.8 | C | 1.35 | 0.9 | D |
| Comparative Example 14 | 14 | 1.32 | 0.8 | C | 1.35 | 0.8 | D |
| Comparative Example 15 | 15 | 1.34 | 0.7 | C | 1.35 | 0.8 | D |
| Comparative Example 16 | 16 | 1.34 | 0.6 | C | 1.34 | 0.7 | D |
| Comparative Example 17 | 17 | 1.22 | 0.4 | C | 1.30 | 0.6 | D |
| Comparative Example 18 | 18 | 1.50 | 0.4 | C | 1.51 | 0.6 | D |

TABLE 5-continued

| | | Normal-temperature, normal-humidity environment | | | High-temperature, high-humidity environment | | |
|---|---|---|---|---|---|---|---|
| | | Density | Fogging | Transfer defects | Density | Fogging | Transfer defects |
| Comparative Example 19 | 19 | 1.35 | 0.7 | C | 1.35 | 0.6 | D |
| Comparative Example 20 | 20 | 1.40 | 0.4 | D | 1.39 | 0.6 | D |
| Comparative Example 21 | 21 | 1.50 | 0.4 | E | 1.51 | 0.6 | E |
| Comparative Example 22 | 22 | 1.25 | 0.2 | C | 1.32 | 0.3 | A |
| Comparative Example 23 | 23 | 1.50 | 0.4 | E | 1.51 | 0.6 | E |
| Comparative Example 24 | 24 | 1.25 | 0.2 | A | 1.32 | 0.3 | A |
| Comparative Example 25 | 25 | 1.35 | 0.6 | E | 1.36 | 0.6 | E |
| Comparative Example 26 | 26 | 1.25 | 0.2 | A | 1.32 | 0.3 | A |
| Comparative Example 27 | 27 | 1.35 | 0.6 | E | 1.36 | 0.7 | E |
| Comparative Example 28 | 28 | 1.25 | 0.2 | A | 1.32 | 0.3 | A |
| Comparative Example 29 | 29 | 1.35 | 0.7 | E | 1.36 | 0.7 | E |
| Comparative Example 30 | 30 | 1.25 | 0.2 | A | 1.32 | 0.3 | A |
| Comparative Example 31 | 31 | 1.34 | 0.6 | E | 1.36 | 0.6 | E |
| Comparative Example 32 | 32 | 1.25 | 0.2 | A | 1.32 | 0.3 | A |
| Comparative Example 33 | 33 | 1.50 | 0.4 | E | 1.51 | 0.6 | E |
| Comparative Example 34 | 34 | 1.25 | 0.2 | A | 1.32 | 0.3 | A |
| Comparative Example 35 | 35 | 1.50 | 0.4 | E | 1.51 | 0.6 | E |
| Comparative Example 36 | 36 | 1.25 | 0.2 | A | 1.32 | 0.3 | A |
| Comparative Example 37 | 37 | 1.50 | 0.4 | E | 1.51 | 0.6 | E |
| Comparative Example 38 | 38 | 1.25 | 0.2 | A | 1.32 | 0.3 | A |
| Comparative Example 39 | 39 | 1.50 | 0.4 | E | 1.51 | 0.6 | E |
| Comparative Example 40 | 40 | 1.25 | 0.2 | A | 1.32 | 0.3 | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-019518, filed on Feb. 1, 2012, which is hereby incorporated by reference herein in its entirety.

REFERENCE SIGNS LIST

1: main casing
2: rotating member
3, 3*a*, 3*b*: stirring member
4: jacket
5: raw material inlet port
6: product discharge port
7: center shaft
8: drive member
9: processing space
10: end surface of the rotating member
11: direction of rotation
12: back direction
13: forward direction
16: raw material inlet port inner piece
17: product discharge port inner piece
d: distance showing the overlapping portion of the stirring members
D: stirring member width
100: electrostatic latent image-bearing member (photosensitive member)
102: toner-carrying member (developing sleeve)
103: developing blade
114: transfer member (transfer roller)
116: cleaner
117: charging member (charging roller)
121: laser generator (latent image-forming means, photoexposure apparatus)
123: laser
124: register roller
125: transport belt
126: fixing unit
140: developing device
141: stirring member

The invention claimed is:

1. A magnetic toner comprising:

magnetic toner particles comprising a binder resin and a magnetic body; and inorganic fine particles that are present on the surface of the magnetic toner particles and are not a magnetic iron oxide and magnetic iron oxide particles that are present on the surface of the magnetic toner particles, wherein;

the inorganic fine particles present on the surface of the magnetic toner particles comprise metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein;

when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the magnetic toner has a coverage ratio A of at least 45.0% and not more than 70.0% and a ratio [coverage ratio B/coverage ratio A] of the coverage ratio B to the coverage ratio A of at least 0.50 and not more than 0.85, and wherein;

the magnetic iron oxide particles present on the surface of the magnetic toner particles are from at least 0.10 mass % to not more than 5.00 mass % with respect to a total amount of the magnetic toner.

2. The magnetic toner according to claim 1, wherein a coefficient of variation on the coverage ratio A is not more than 10.0%.

3. The magnetic toner according to claim 1, wherein the magnetic toner has a dielectric constant ∈', at a frequency of 100 kHz and a temperature of 40° C., of at least 40.0 pF/m.

* * * * *